US012240638B2

(12) United States Patent
Tsujimoto et al.

(10) Patent No.: US 12,240,638 B2
(45) Date of Patent: Mar. 4, 2025

(54) DEGASIFIER

(71) Applicant: ASAHI INDUSTRY CO., LTD., Aichi (JP)

(72) Inventors: Shuhei Tsujimoto, Aichi (JP); Toru Nakanishi, Aichi (JP); Shusuke Kinoshita, Aichi (JP)

(73) Assignee: ASAHI INDUSTRY CO, LTD., Aichi (JP)

( * ) Notice: Subject to any disclaimer, the term of this patent is extended or adjusted under 35 U.S.C. 154(b) by 0 days.

(21) Appl. No.: 18/114,116

(22) Filed: Feb. 24, 2023

(65) Prior Publication Data

US 2023/0211909 A1 Jul. 6, 2023

Related U.S. Application Data

(63) Continuation of application No. PCT/JP2021/030576, filed on Aug. 20, 2021.

(30) Foreign Application Priority Data

Aug. 25, 2020 (JP) ..... 2020-141716

(51) Int. Cl.
*B65B 31/04* (2006.01)

(52) U.S. Cl.
CPC ..... *B65B 31/048* (2013.01)

(58) Field of Classification Search
CPC ..... B65B 31/00; B65B 31/048; B65B 31/024; B65B 43/30

(Continued)

(56) References Cited

U.S. PATENT DOCUMENTS 2,634,562 A 4/1953 Mueller et al.
6,256,968 B1 * 7/2001 Kristen ..... F04B 49/022 53/512

(Continued)

FOREIGN PATENT DOCUMENTS

DE 3632723 A1 3/1988
EP 1564147 A1 * 8/2005 ..... B65B 31/024

(Continued)

OTHER PUBLICATIONS

International Search Report issued in corresponding International Patent Application No. PCT/JP2021/030576, dated Nov. 2, 2021, with English translation.

(Continued)

*Primary Examiner* — Stephen F. Gerrity
*Assistant Examiner* — Linda J Hodge
(74) *Attorney, Agent, or Firm* — Rimon P.C.

(57) ABSTRACT

Provided is a compact degasifier that can degas a packaging bag that is smooth on the inside, without inserting a nozzle into the bag opening. Suction ports are formed facing each other, with a packaging bag interposed therebetween, on pressing surfaces that hold the packaging bag, of a pair of rubber seals that grip the packaging bag. The degasifier is configured such that an air passage is formed that connects the inside and the outside of a degassing chamber, same being formed on the inside of the packaging bag and being formed when the inside of the suction ports are depressurized by a decompression means, in a state in which the packaging bag is held between the pair of rubber seals and the bag opening of the packaging bag is disposed inside the sealed degassing chamber.

4 Claims, 20 Drawing Sheets

(58) Field of Classification Search
USPC ..... 53/512
See application file for complete search history.

(56) References Cited

U.S. PATENT DOCUMENTS

| | | | | | |
|---|---|---|---|---|---|
| 7,131,250 | B2 * | 11/2006 | Kahn | B65B 51/146 | 53/434 |
| 2006/0207226 | A1 * | 9/2006 | Levsen | B65B 31/046 | 53/512 |
| 2010/0180548 | A1 * | 7/2010 | Binger | B65D 81/2038 | 53/512 |
| 2020/0039670 | A1 * | 2/2020 | Thürig | B65B 31/024 | |

FOREIGN PATENT DOCUMENTS

| | | | | | |
|---|---|---|---|---|---|
| JP | 03-069415 | A | | 3/1991 | |
| JP | 3035523 | U | | 3/1997 | |
| JP | 09-110012 | A | | 4/1997 | |
| JP | 2003-40214 | A | | 2/2003 | |
| JP | 3166827 | U | | 3/2011 | |
| JP | 2015-003766 | A | | 1/2015 | |
| JP | 2018-184177 | A | | 11/2018 | |
| KR | 20180019358 | A | * | 2/2018 | B65B 31/024 |

OTHER PUBLICATIONS

Extended European Search Report dated Sep. 10, 2024, from corresponding EP Application No. 21861420.4, 9 pages.

* cited by examiner

DEGASIFIER

RELATED APPLICATION

This application is a Continuation Application of International Application No. PCT/JP2021/030576, filed Aug. 20, 2021, which claims priority to Japan Application No. JP2020-141716, filed Aug. 25, 2020. The subject matter of each is incorporated herein by reference in entirety.

TECHNICAL FIELD

The present invention relates to a degasifier that removes gas from a packing bag storing a packed material.

BACKGROUND ART

Degasifiers that degas a packing bag storing a packed material are widely known. Such degasifiers include, a type (patent literature 1 for example), in which degassing is performed while a nozzle is inserted into a bag opening of a packing bag, a type (patent literature 2 for example), in which degassing is performed while an entire packing bag is stored in a degassing chamber, and a type (patent literature 3 for example), in which degassing is performed while only peripheral parts of a bag opening of a packing bag are arranged in a degassing chamber.

CITATION LIST

Patent Literature

Patent Literature 1: Japanese Registered Utility Model Publication 3166827

Patent Literature 2: Japanese Registered Utility Model Publication 3035523

Patent Literature: Japanese Patent Application Publication 2003-040214

SUMMARY OF INVENTION

Technical Problem

In the degasifier of the patent literature 1 described above, there is a high risk that the inside of a bag is likely contaminated via a nozzle since the nozzle is inserted into the bag when degassing is performed. With the degasifier of the patent literature 2 described above, a nozzle is not inserted when degassing is performed, so this problem does not occur. However, it has a problem that a size of a device is big since a degassing chamber needs to be big enough to store an entire packing bag that stores packed materials. With the degasifier of the patent literature 3, the problems described above do not occur. However, in the degasifier of the patent literature 3, use of a special packing bag, in which convex-concave is formed on an inner surface, is prerequisite. Normal packing bags with smooth inner surface cannot be used, so a running cost is high unfortunately. The degasifier of the patent literature 3 performs degassing in a state where the packing bag is sandwiched between a lid and a body, which form a degassing chamber. So, when a normal packing bag is used, the air in the bag cannot pass through the part sandwiched between the lid and the body, and the air in the bag cannot preferably be discharged from the bag opening.

The present invention is made in consideration of such situations, and aimed at providing a degasifier, which does not require a nozzle to be inserted into a bag opening, which allows a packing bag with a smooth inner surface to be used therein, and which is compact in size.

Solution to Problem

The present invention is directed to a degasifier comprising: a degassing chamber, which is openable or closable, and which is closed in a state where a lid is mounted on a body; and a pair of gaskets, each provided in the body and the lid, that pressure-contact to each other around the degassing chamber in a state where the lid is mounted on the body, wherein a packing bag is sandwiched between the pair of gaskets, and a bag opening of the packing bag is arranged inside the closed degassing chamber, and in this state, the packing bag can be degassed by decompressing inside the degassing chamber, the degasifier is characterized by comprising: a pair or pairs of suction opening, which open in sandwiching surfaces for sandwiching the packing bag and mutually opposing to each other while sandwiching the packing bag; and a decompression means that can decompress an inside of the suction opening, the degasifier being characterized in that, in a state where the packing bag is sandwiched between the pair of gaskets and the bag opening of the packing bag is arranged in the closed degassing chamber, and when an inside of the suction opening is decompressed by the decompression means, an airway, which communicates an inside and an outside of the degassing chamber can be formed.

According to this structure, by decompressing an inside of a suction opening, an airway, which can pass through gaskets sandwiching a packing bag, can be formed. So, even if the packing bag has a smooth inner surface, air inside the bag can be suitably discharged via the airway from a bag opening. In this way, with the degasifier of the present invention, even if the packing bag has a smooth inner surface, degassing can suitably be performed without inserting a nozzle into the bag opening. Also, the degasifier of the present invention, is a type that sandwiches a packing bag between a lid and a body, and stores only part of the packing bag in a degassing chamber. So, the degasifier of the present invention can be realized compactly in size.

In the present invention, the also suggested is characterized in that, in a state where the packing bag is degassed, the bag opening of the packing bag can be sealed, and one of the body and the lid is provided with an electrically-heated wire to seal the bag opening in the degassing chamber, the other of the body and the lid is provided with a pressing member to press the bag opening to the electrically-heated wire in the degassing chamber, the pressing member is held in the closed degassing chamber, such that the pressing member is movable between, a pressing position where the bag opening arranged between the electrically-heated wire and the pressing member can be pressed to the electrically-heated wire, and an evacuation position where the bag opening cannot be pressed to the electrically-heated wire, the pressing member is biased to the evacuation position by a biasing means, when an inside of the closed degassing chamber is decompressed to the predetermined pressure or lower, the pressing member moves to the pressing position against the biasing force of the biasing means by an air pressure difference between an inside and an outside of the degassing chamber.

According to this structure, a bag opening is not pressed to an electrically-heated wire by a pressing member until an inside of a degassing chamber is decompressed to a predetermined pressure or lower. So, air inside a packing bag can smoothly discharged from the bag opening. Also, according to this structure, the pressing member is displaced by an air pressure difference between an inside and an outside of the degassing chamber. So, a driving means for displacing the pressing member is not necessary.

In the present invention, also suggested is the degasifier characterized in that, the decompression means comprises: a vacuum pump arranged in the body; a first suction pipe that communicates the suction opening of the gasket on the body side to the vacuum pump; and a second suction pipe that communicates the suction opening of the gasket on the lid side to the vacuum pump, in each of the pair of gaskets, in a state where the lid is mounted on the body, on close-contact surfaces that do not sandwich the packing bag and that tightly contact to each other, a mutually overlapping link opening is open, the second suction pipe comprises: a body-side suction pipe that is arranged in the body and communicates the link opening of the gasket on the body side to the vacuum pump; and a lid-side suction pipe that is arranged on in the lid and communicates a suction opening of the gasket on the lid side to the link opening of the gasket on the lid side.

According to this structure, in a state where a lid is mounted on a body, a pair of gaskets comes into close contact, and the link openings on the body side and the lid side are connected. Accordingly, a suction opening of the gasket on the lid side is connected to a vacuum pump, and therefore the suction pipe, which connects a suction opening of the gasket on the lid side to the vacuum pump can be simplified. Also, there is benefit that, when the lid is removed, the body side suction pipe and the lid-side suction pipe are separated, so the lid can be separated from the body without being restrained by the suction pipe.

In the present invention, also suggested is the degasifier characterized by comprising a stopper, which, in a state where the lid is mounted on the body, prevents a degree of close-contact of the pair of gaskets from becoming a predetermined degree or more.

When the degassing chamber is decompressed, the lid is pressed against the body by a pressure difference between the inside and the outside of the degassing chamber. If the gaskets are excessively tightly contact to each other at this point, the gaskets become hardly deformed in the periphery of the suction opening, and the airway becomes hardly formed unfortunately. On the other hand, with this structure, the gaskets can be prevented from being excessively tightly contact to each other, so the airway can easily be formed around the suction opening.

Advantageous Effects of Invention

As described above, according to the present invention, such a degasifier can be realized, in which a packing bag can be degassed without inserting a nozzle in a bag opening, a packing bag with a smooth inner surface can be used, and a size is compact.

BRIEF DESCRIPTION OF DRAWINGS

FIG. 13*a* and FIG. 13*b* is an enlarged view of a front-side center part of a degasifier 1 in a degassing process, in which FIG. 13*a* shows suction openings 21*a*, 21*b* before decompression and FIG. 13*b* shows suction openings 21*a*, 21*b* after decompression.

DESCRIPTION OF EMBODIMENT

Embodiment of the present invention is explained by the following examples. In the following example, a decompression means according to the present invention corresponds to a vacuum pump 29 and suction pipes 27*a* to 27*c*. Also, a first suction pipe according to the present invention corresponds to the suction pipe 27*a*, and a second suction pipe corresponds to the suction pipes 27*b*, 27*c*. The body-side suction pipe according to the present invention relates to the suction pipe 27*b*, and the lid-side suction pipe corresponds to the suction pipe 27*c*. A biasing means according to the present invention corresponds to an elastic gasket 17. A stopper according to the present invention corresponds to inner wall parts 37*a*, 37*b*.

Example 1

Figure 1:
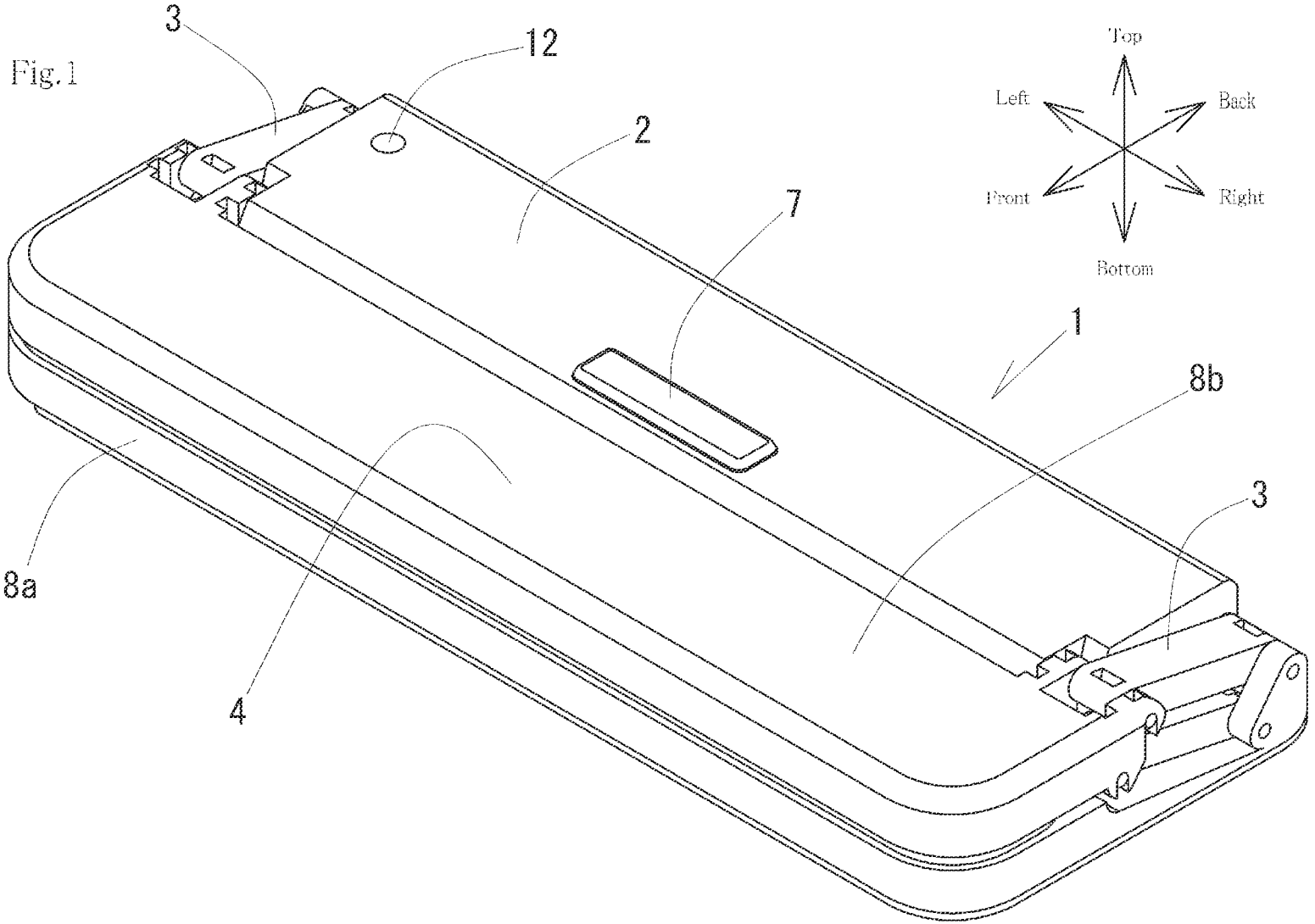
FIG. 1 is a perspective view of a degasifier 1 in a mount state.
Figure 2:
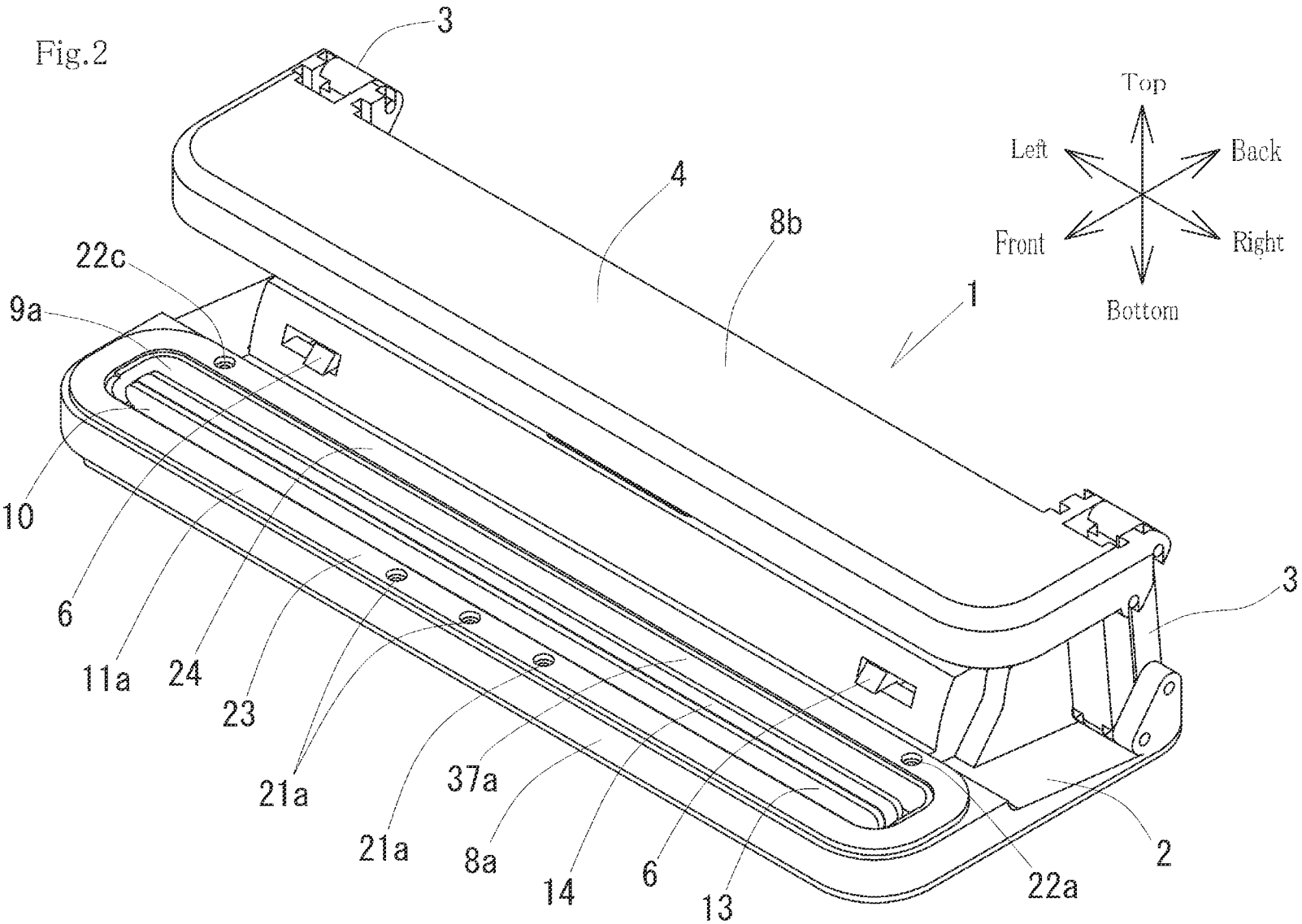
FIG. 2 is a perspective view of a degasifier 1 in a released state.

A degasifier 1 of the present example is the one that degases a plastic packing bag storing a packed material and then welds and seals a bag opening. As shown in FIGS. 1, 2, the degasifier 1 includes, a body 2, and a lid 4 that is linked to the body 2 via an arm 3. The lid 4 is convertible, by rotating the arm 3, between a mount state (refer to FIG. 1), in which the lid 4 is mounted on a front-side portion of the body 2, and a released state (refer to FIG. 2), in which the lid 4 moves apart above the body 2. The arm 3 is biased to one direction by a spring (not shown), and the lid 4 is kept in the released state by biasing force of this spring. The body 2 is provided with a movable hook 6 that can engage with the lid 4 in the mount state. When the lid 4 is converted from the released state to the mount state against the biasing force of the spring, the lid 4 is kept in the mount state. The movable hook 6, which is engaged with the lid 4, can be evacuated to the place where the movable hook 6 and the lid 4 are not engaged, by operating a release button 7 arranged in the upper portion of the body 2. The lid 4 kept in the mount state can be returned to the released state by operating the release button 7. A display lamp 12, which shows an operating condition, is arranged in a upper left portion of the body 2.

Figure 3:
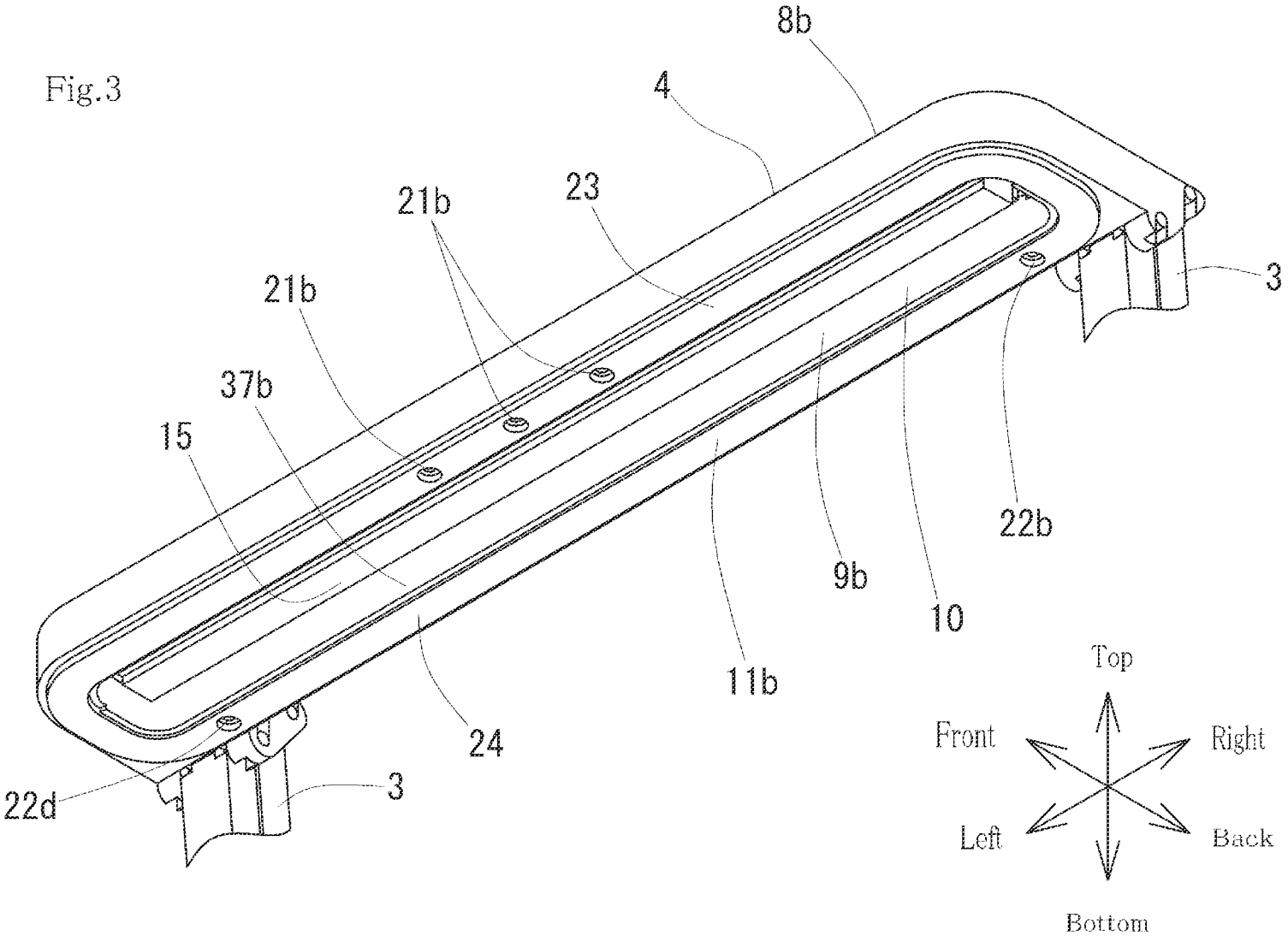
FIG. 3 is a perspective view showing a bottom surface side of a lid 4.
Figure 4:
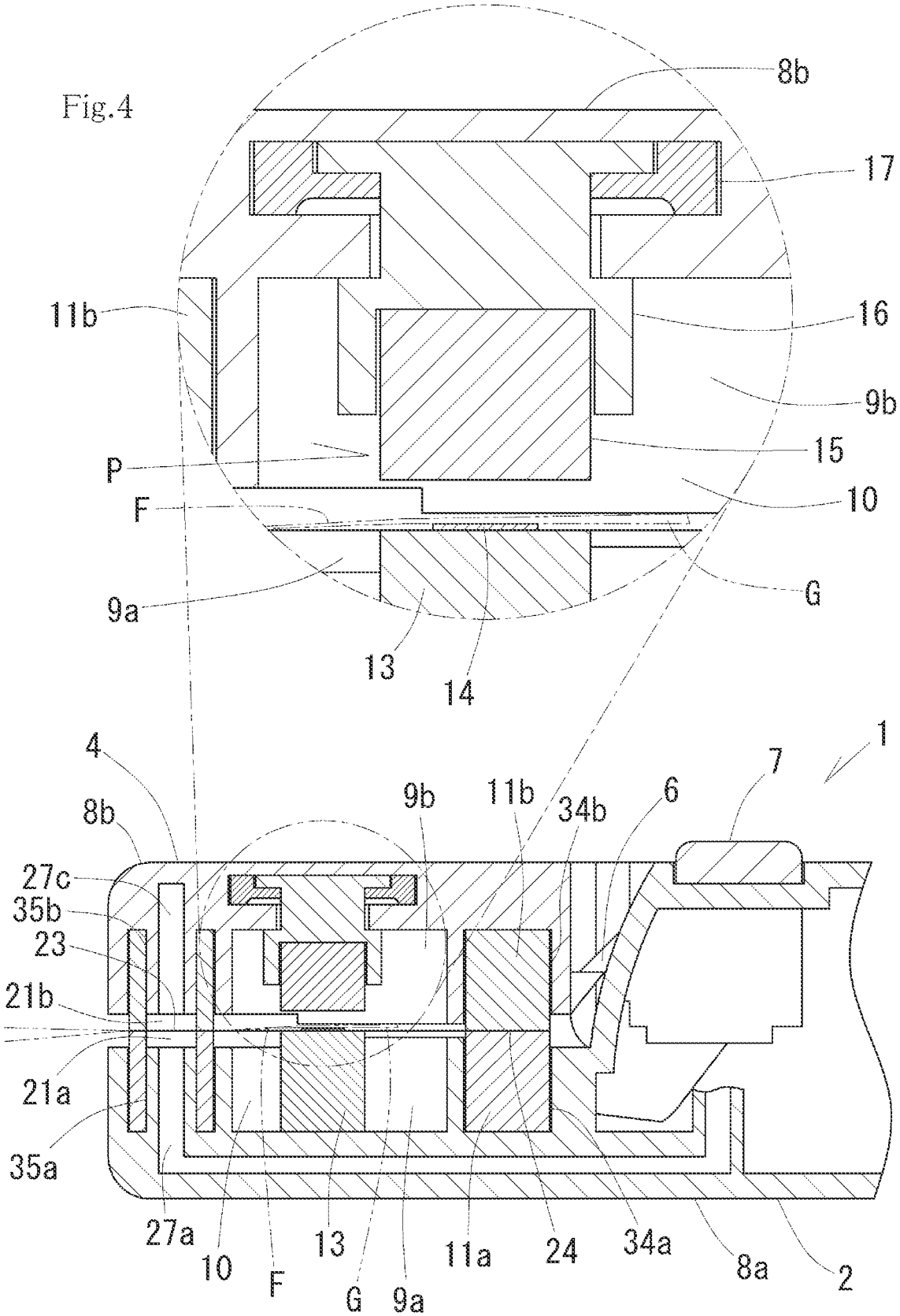
FIG. 4 is an enlarged longitudinal section view of a degasifier 1 in a mount state.
Figure 5:
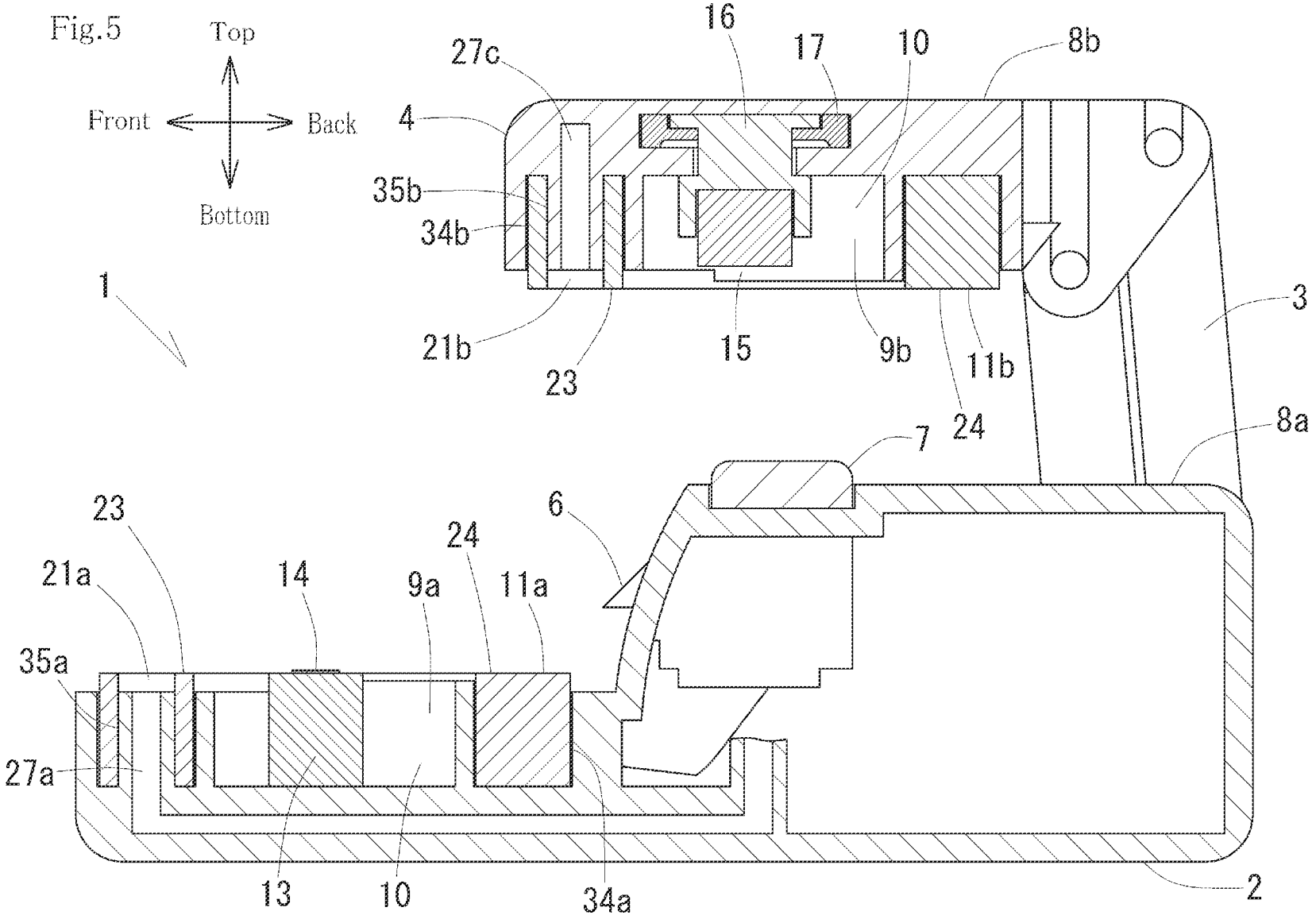
FIG. 5 is a longitudinal section view of a degasifier 1 in a released state.

As shown in FIGS. 2 to 5, an upper surface of a front-side portion of a case 8*a* of the body 2 is provided with a concave part 9*a*, and a bottom surface of a case 8*b* of the lid 4 is provided with a concave part 9*b*, such that this pair of concave parts, which forms the degassing chamber 10, faces each other vertically when the lid 4 is in the mount state. Openings of two concave parts 9*a*, 9*b* have substantially the same horizontally long shapes. When the lid 4 is in the mount state, the openings of two concave parts 9*a*, 9*b* neatly overlap one another, and the closed degassing chamber 10 is formed between the body 2 and the lid 4. As shown in FIG. 5, when the lid 4 is in the released state, two concave parts 9*a*, 9*b* separate from each other and thus the degassing chamber 10 is released. The case 8*a* of the body 2 and the case 8*b* of the lid 4 are provided with a pair of ring-shaped gasket 11*a*, 11*b* to surround opening edges of the concave parts 9*a*, 9*b*. When the lid 4 is in the mount state, these gaskets 11*a*, 11*b* press-contact each other around the degassing chamber 10 such that the degassing chamber 10 is tightly closed.

As shown in FIG. 2, the concave part 9*a* on the body side is provided with a rib 13 extending in the width direction, and upper surface of the rib 13 is provided with an electrically-heated wire 14 in the longitudinal direction. The degasifier 1 temporarily heats the electrically-heated wire 14 by flowing a large electric current, thereby sealing a bag opening of the packing bag with an impulse seal method. The electrically-heated wire 14 may be covered with a protective tape to prevent adherence of the packing bag.

As shown in FIGS. 3 to 5, the concave part 9*b* on the lid side is provided with a pressing member 15, which is made from silicon rubber elongating in the width direction. The pressing member 15 is held at the place where the pressing member 15 faces vertically with the electrically-heated wire 14 when the lid 4 is in the mount state. The pressing member 15 is held by a holding member 16, which is vertically movably attached to the case 8*b* of the case 4. As shown in FIG. 4, the holding member 16 is biased upwards by the elastic force of the elastic gasket 17 interposed between the case 8*b* and the holding member 16. The pressing member 15 is normally held, by the upwardly-biased holding member 16, at an evacuation position P, which separates the bottom surface from the electrically-heated wire 14. However, by moving down the lid 4 against the elastic force of the elastic gasket 17, the pressing member 15 can be moved down to a pressing position Q where the pressing member can press the electrically-heated wire 14 on the bottom surface.

Figure 6:
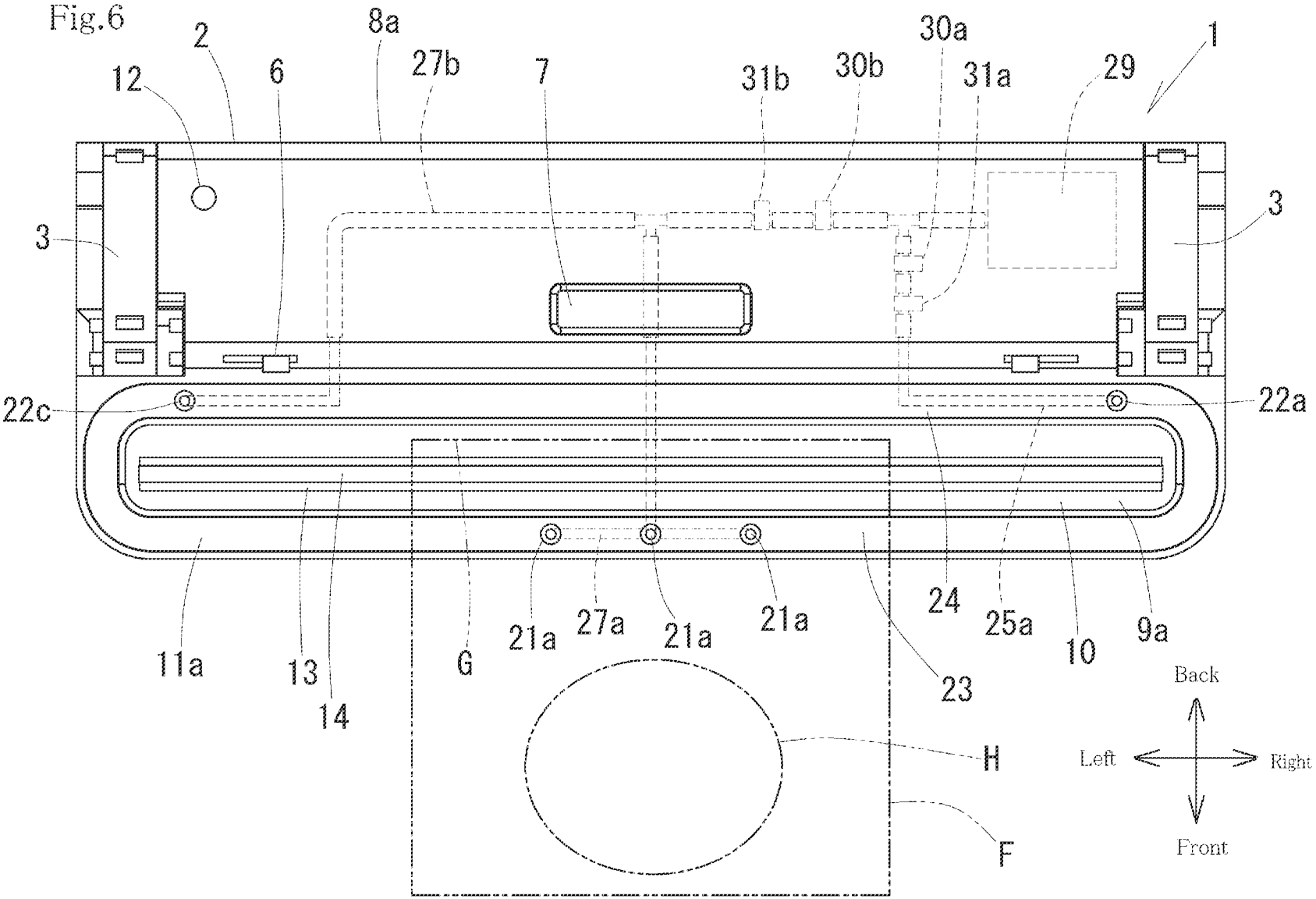
FIG. 6 is a plan view of a degasifier 1, from which a lid 4 is omitted.
Figure 7:
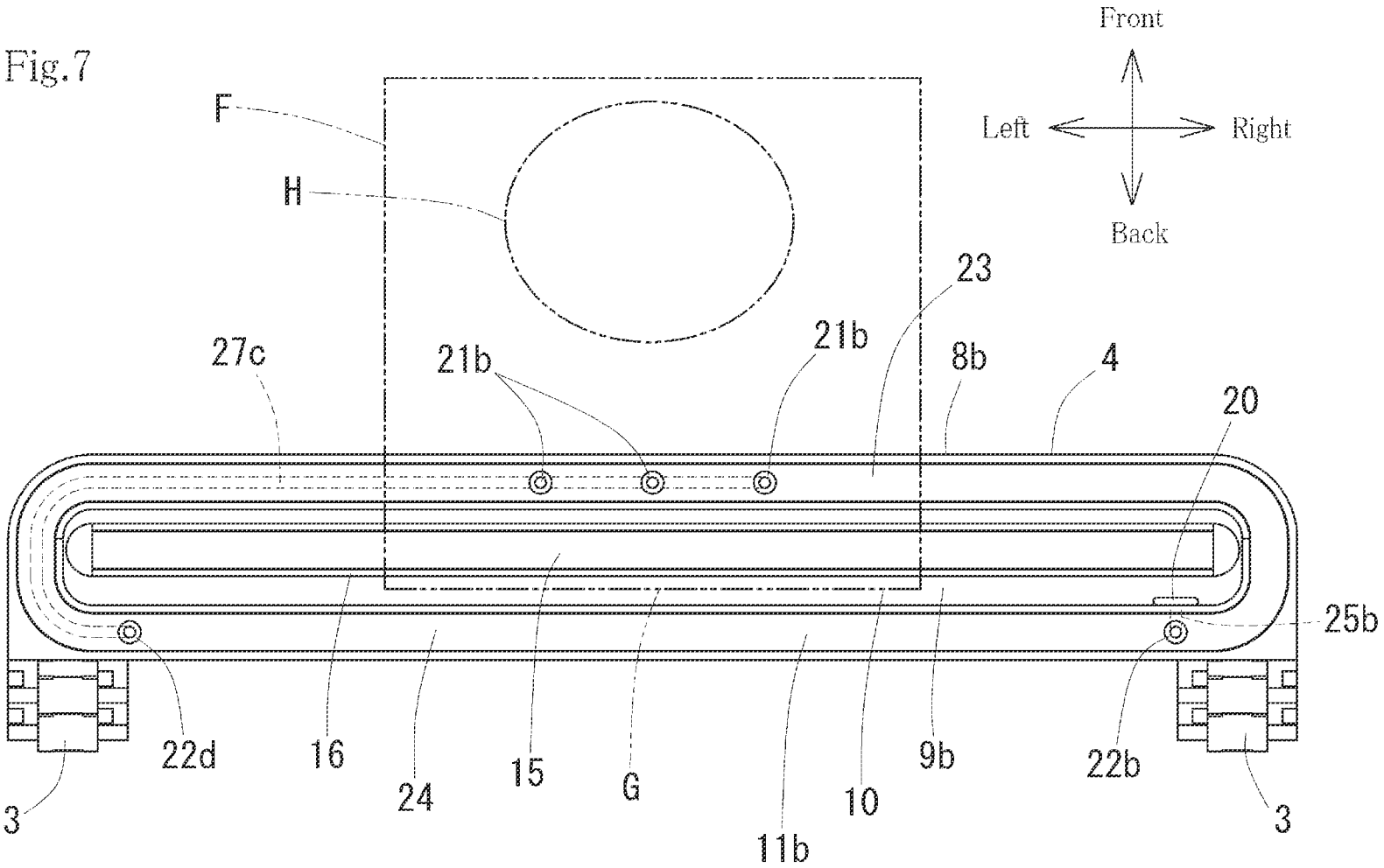
FIG. 7 is a bottom view of a lid 4.

As shown in FIGS. 6, 7, as to the gaskets 11*a*, 11*b* of the body 2 and the lid 4, among surfaces 23, 24 that press-contact each other in the mount state of the lid 4, a front-side portion constitutes a sandwiching surface 23 that sandwiches a packing bag F, and left and right portions and a back portion do not sandwich the packing bag F but constitutes close-contact surfaces 24 that are brought into close contact with each other. In the center portion of the sandwiching surface 23 of each of the gaskets 11*a*, 11*b*, three round-shaped suction openings 21*a*, 21*b*, which open the packing bag vertically, are formed. Also, in the right and left side portions of the close-contact surface 24 of each of the gaskets 11*a*, 11*b*, round-shaped link openings 22*a* to 22*d*, which overlap with each other in the mount state of the lid 4, are formed. As shown in FIG. 7, in the case 8*b* of the lid 4, a degassing opening 20 that discharges air from the degassing chamber 10, is formed.

The degassing opening 20 and the suction openings 21*a*, 21*b* described above, are connected to an intake opening of the vacuum pump 29 arranged inside the case 8*a* of the body 2. Specifically, as shown in FIGS. 6, 7, the degassing opening 20 is connected, via a degassing pipe 25*a* on the body side and a degassing pipe 25*b* on the lid side, to the vacuum pump 29. The degassing pipe 25*a* on the body side, is formed with hard resin forming the case 8*a* and a silicon tube arranged inside the case 8*a*, and communicates the vacuum pump 29 and the link opening 22*a*, which opens in the right side portion of the close-contact surface 24 of the body-side gasket 11*a*. The degassing pipe 25*b* on the lid side is formed with hard resin that forms the case 8*b*, and communicates the degassing opening 20 and a link opening 22*b* that opens at the right back portion of the close-contact surface 24 of the lid-side gasket 11*b*. When the lid 4 is in the mount state, and when the gaskets 11*a*, 11*b* are brought into tight contact while the link opening 22*a* and the link opening 22*b* overlap with each other, the degassing pipe 25*a* on the body side and the degassing pipe 25*b* on the lid side are connected. The degassing pipe 25*a* on the body side is provided with a solenoid valve 30*a* and a regulator 31*a* for adjusting a degree of vacuum.

As shown in FIG. 6, the suction opening 21*a* that opens in the body-side gasket 11*a* is connected to the vacuum pump 29 via the hard resin forming the case 8*a* of the body 2 and via the suction pipe 27*a* formed with the silicon tube inside the case 8*a*. As shown in FIGS. 6, 7, the suction opening 21*b* that opens in the lid-side gasket 11*b* is connected to the vacuum pump 29 via the suction pipe 27*b* on the body side and via the suction pipe 27*c* on the lid side. The suction pipe 27*b* on the body side, is formed with hard resin forming the case 8*a* and with a silicon tube arranged inside the case 8*a*, and communicates the vacuum pump 29 and the link opening 22*c*, which opens in the left side portion of the close-contact surface 24 of the body-side gasket 11*a*. The suction pipe 27*c* on the lid side is formed with hard resin that forms the case 8*b*, and communicates the suction opening 21 on the lid side and a link opening 22*d* that opens at the left back portion of the close-contact surface 24 of the lid-side gasket 11*b*. When the lid 4 is in the mount state, and when the gaskets 11*a*, 11*b* are brought into tight contact while the link opening 22*c* and the link opening 22*d* overlap with each other, the suction pipe 27*b* on the body side and the suction pipe 27*c* on the lid side are connected. The suction pipes 27*a*, 27*b* on the body side is provided with a solenoid valve 30*b* and a regulator 31*b* for adjusting a degree of vacuum. The degassing pipe 25*a* and the suction pipes 27*a*, 27*b* are joined in the vicinity of the vacuum pump 29. However, the solenoid valve 30*b* and the regulator 31*b* arranged in the suction pipes 27*a*, 27*b* are different from the ones arranged in the degassing pipe 25*a*. The degassing pipe 25*a* and the suction pipes 27*a*, 27*b* are independently controlled for opening or closing, and adjusted to different degrees of vacuum. Specifically, in the present example, when the vacuum pump 29 is in operation, the suction openings 21*a*, 21*b* are adjusted to have a higher degree of vacuum than the degassing opening 20 (degassing chamber 10).

Figure 8:
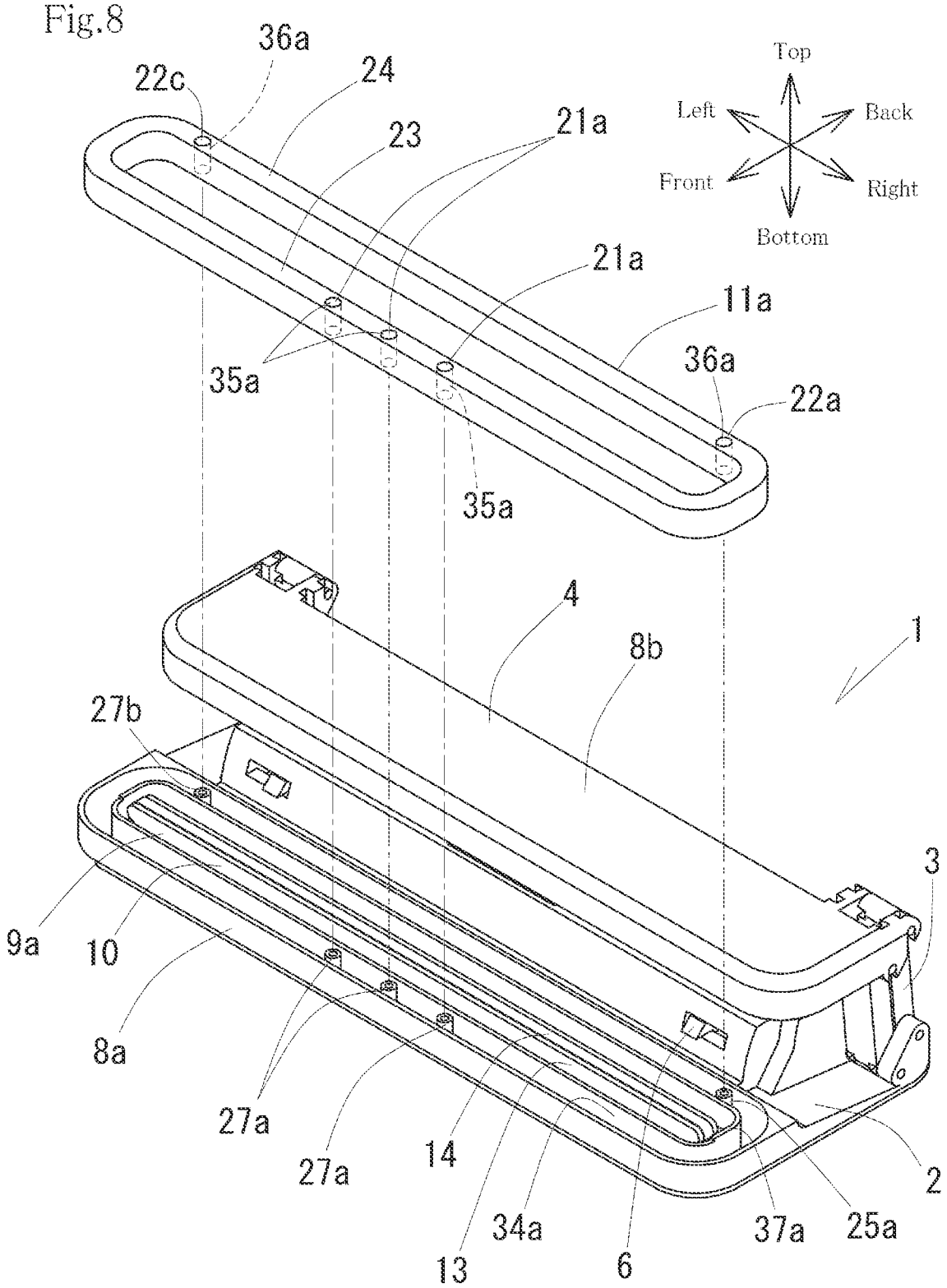
FIG. 8 is a perspective view of a degasifier 1, in which a body-side gasket 11*a* is separately shown.
Figure 9:
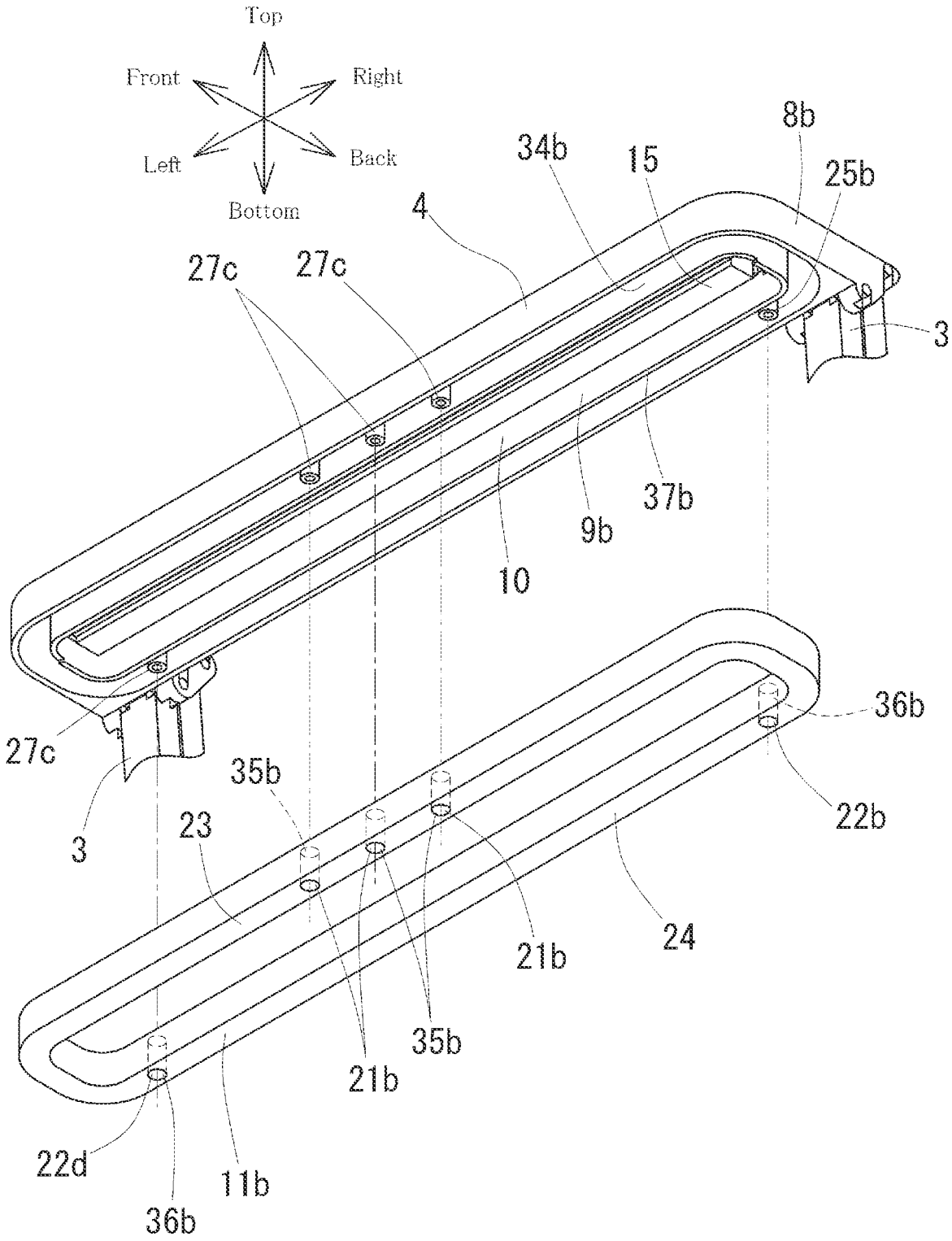
FIG. 9 is a perspective view of a lid 4, in which a lid-side gasket 11*b* is separately shown.

As shown in FIGS. 8, 9, the body-side gasket 11*a* and the lid-side gasket 11*b* are made from the similarly shaped ring-shaped silicon rubber. The sandwiching surface 23 and the close-contact surface 24 of the gaskets 11*a*, 11*b* each have a horizontal flat surface, such that the sandwiching surface 23 and the close-contact surface 24 can be brought into close contact with each other and with the surface of the packing bag F. At the center portion of each of the sandwiching surfaces 23, round-shaped through-holes 35*a*, 35*b*, which form the suction openings 21*a*, 21*b*, passes through vertically. Also, at the right and left side portions of the close-contact surface 24 of each of the gaskets 11*a*, 11*b*, round-shaped through-holes 36*a*, 36*b*, which form the link openings 22*a* to 22*d*, pass through vertically. The through-holes 35*a*, 35*b*, 36*a*, 36*b* in each of the gaskets 11*a*, 11*b* are formed with the same size and the same shape in the symmetry positions of the sandwiching surface 23 and the close-contact surface 24, such that the suction openings 21*a*, 21*b* and the link openings 22*a* to 22*d* formed in the opposing positions precisely overlap with each other when the lid 4 is in the mount state.

As shown in FIG. 8, the body-side gasket 11*a* is fit to a round-shaped groove 34*a* formed around the concave part 9*a* of the case 8*a* of the body 2. The groove 34*a* is provided with the end parts of the cylindrical suction pipes 27*a*, 27*b* and the degassing pipe 25*a* in the protruding manner. The body-side gasket 11*a* is fit to the groove 34*a*, such that the through-holes 35*a*, 36*a*, which form the suction opening 21*a* and the link openings 22*a*, 22*c*, are fit from outside to the end parts of the degassing pipe 25*a* and the suction pipe 27*a*, respectively. If the body-side gasket 11*a* is fit as shown in the above configuration, the suction opening 21*a* or the like that opens to the body-side gasket 11*a* can easily be connected to the suction pipe 27*a* or the like. Furthermore, positions of the suction opening 21*a* or the like will not be displaced in the longitudinal direction of the groove 34*a* when the body-side gasket 11*a* is fit to the groove 34*a*.

As shown in FIG. 9, the lid-side gasket 11*b* is fit to a ring-shaped groove 34*b* formed around the concave part 9*b* of the case 8*b* of the lid 4. The groove 34*b* is provided with the end parts of the cylindrical suction pipes 27*c* and the degassing pipe 25*b* in the protruding manner. The lid-side gasket 11*b* is fit to the groove 34*b*, such that the through-holes 35*b*, 36*b*, which form the suction opening 21*b* and the link openings 22*b*, 22*d*, are fit from outside to the end parts of the degassing pipe 25*b* and the suction pipe 27*c*, respectively. If the lid-side gasket 11*b* is fit as shown in the above configuration, the suction opening 21*b* or the like that open to the lid-side gasket 11*b* can easily be connected to the suction pipe 27*c*. Furthermore, positions of the suction opening 21*b* or the like will not be displaced in the longitudinal direction of the groove 34*b* when the lid-side gasket 11*b* is fit to the groove 34*b*.

As shown in FIGS. 2, 3, the inner wall parts 37*a*, 37*b* of the cases 8*a*, 8*b*, which form the inner wall of the degassing chamber 10, is about 1 mm lower than the gaskets 11*a*, 11*b*. These inner wall parts 37*a*, 37*b* function as a stopper that prevent the gaskets 11*a*, 11*b* from coming into excessively close contact. That is, during the mount state of the lid 4, when the lid 4 is pressed down to compress the gaskets 11*a*, 11*b* in the thickness direction (vertical direction), these inner wall parts 37*a*, 37*b* abut each other, and thereby preventing the gaskets 11*a*, 11*b* from further tightly contacting each other. As to the front side of the inner wall parts 37*a*, 37*b*, the packing bag F is disposed between the inner wall parts 37*a* and 37*b*. So, the front side of the inner wall parts 37*a*, 37*b*, is higher than the back-surface side and the right and left sides to avoid contact between the inner wall parts 37*a*, 37*b* and the packing bag F. In other words, the only members that function as a stopper are the right and left sides and the back surface side of the inner wall parts.

The suction openings 21*a*, 21*b* formed in the sandwiching surface 23 of the gaskets 11*a*, 11*b* have negative pressure inside. And thus, the gaskets 11*a*, 11*b* around the suction openings 21*a*, 21*b* attract the packing bag F, and the sandwiching surfaces 23 are elastically deformed in the separating direction. As shown in FIGS. 4 to 7, the three suction openings 21*a*, 21*b* formed in each of the gaskets 11*a*, 11*b* are formed at the position where the suction openings 21, 21*b* are opposing to each other with the packing bag F interposed therebetween, while forming a pair in the vertical direction. Specifically, the suction openings 21*a*, 21*b* each have a round shape with a diameter about a half of the fore-and-aft width of the gaskets 11*a*, 11*b*. The suction openings 21*a*, 21*b* are formed at the center portion of the sandwiching surface 23, with uniform intervals, along the center line of the fore-and-aft width of the sandwiching surface 23. As shown in FIGS. 8, 9, into the through-holes 35*a*, 35*b* of the gaskets 11*a*, 11*b*, which form the suction openings 21*a*, 21*b*, the end parts of the cylindrical and hard suction pipes 27*a*, 27*c* are fit. As shown in FIGS. 4, 5, the end parts of the suction pipes 27*a*, 27*c* are only inserted to about 1 cm front of the suction openings 21*a*, 21*b*, and the suction openings 21*a*, 21*b* are only formed with easily deformable gaskets 11*a*, 11*b*.

Figure 10:
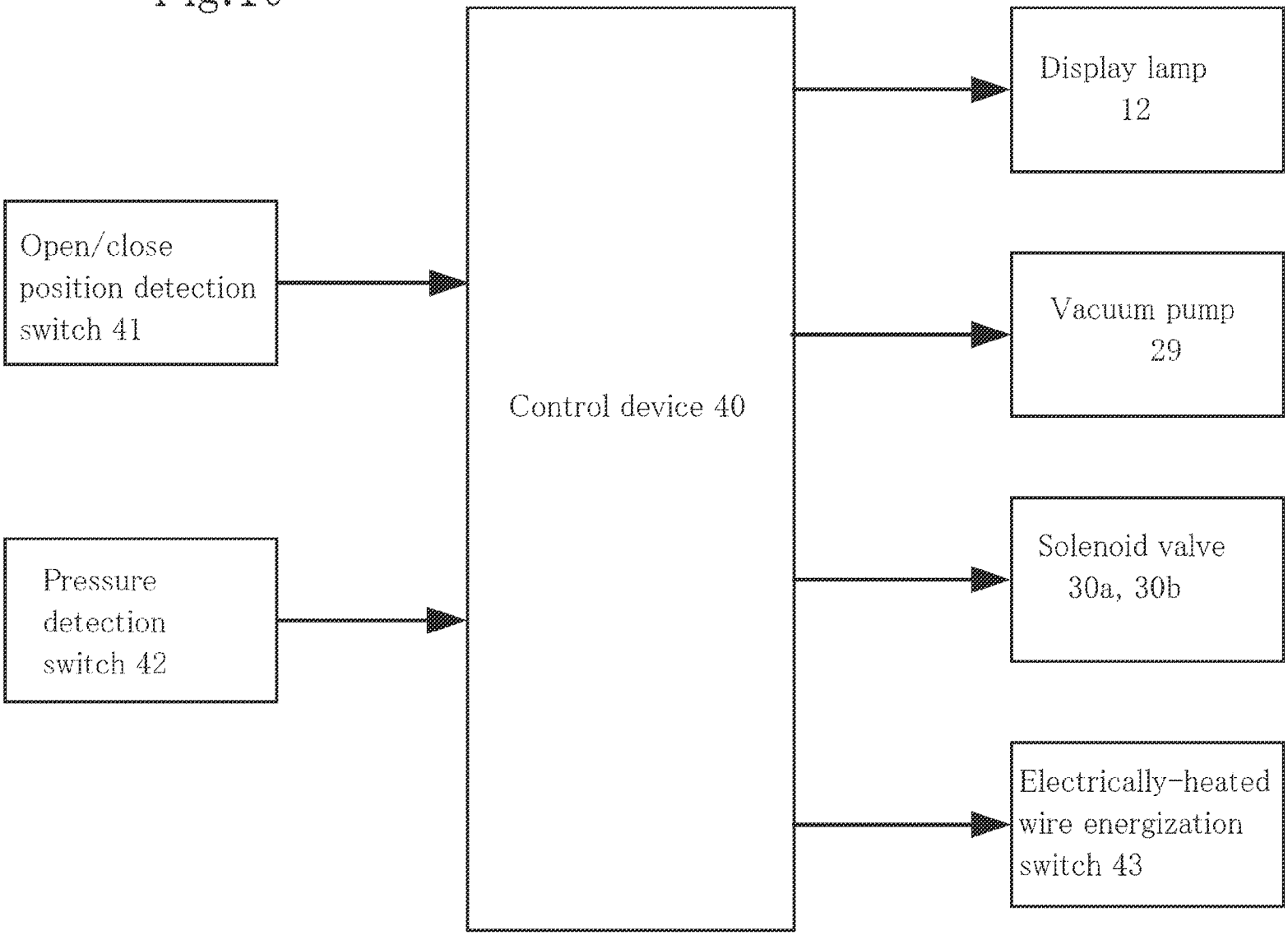
FIG. 10 is a block diagram showing a control circuit of a degasifier 1.

FIG. 10 shows a control circuit of the degasifier 1. A control device 40 of the degasifier 1 is configured with a microcomputer, and arranged inside the case 8*a* of the body 2. To the control device 40, signals are input from an open/close position detection switch 41 and a pressure detection switch 42. The control device 40, based on these input signals, controls the display lamp 12, the vacuum pump 29, the solenoid valves 30*a*, 30*b*, and an electrically-heated wire energization switch 43. The control device 40 may be configured with a sequence circuit instead of the microcomputer.

The open/close position detection switch 41 is a limit switch, which is arranged inside the case 8*a* of the body 2 and detects the position of the movable hook 6 to detect whether the lid 4 is in the mount state. The pressure detection switch 42 is a limit switch, which is arranged inside the case 8*b* of the lid 4 and detects the position of the holding member 16 to detect whether the bottom surface of the pressing member 15 presses the electrically-heated wire 14. The electrically-heated wire energization switch 43 is a switch that changes the electrically-heated wire 14 between an energized state and a unenergized state. The control device 40 controls the energization state of the electrically-heated wire 14 via the electrically-heated wire energization switch 43, thereby making the electrically-heated wire 14 generate heat at a predetermined timing. The vacuum pump 29, as described above, intakes air from the degassing opening 20 and the suction openings 21*a*, 21*b*. The control device 40 controls the vacuum pump 29 and the solenoid valves 30*a*, 30*b* to intake air selectively from the degassing opening 20 and the suction openings 21*a*, 21*b*.

Hereinafter, description is made on how to use the degasifier of the present example.

Figure 11A:
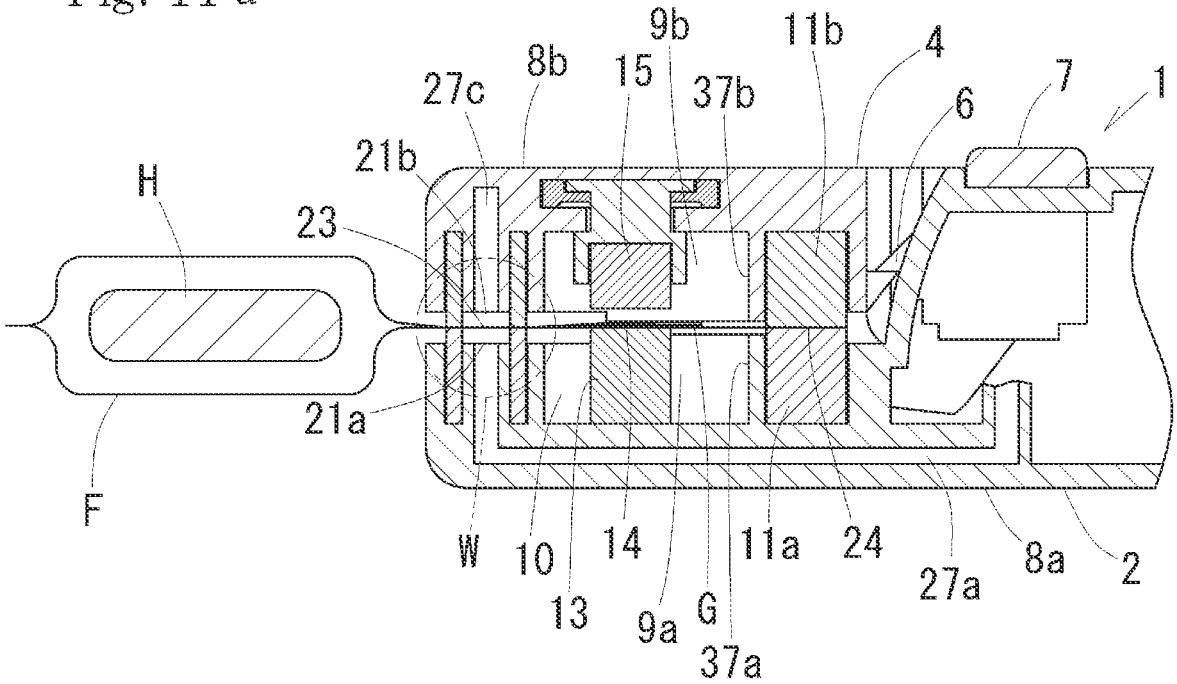
FIG. 11*a* and FIG. 11*b* is an explanatory view showing a degassing process.
Figure 12A:
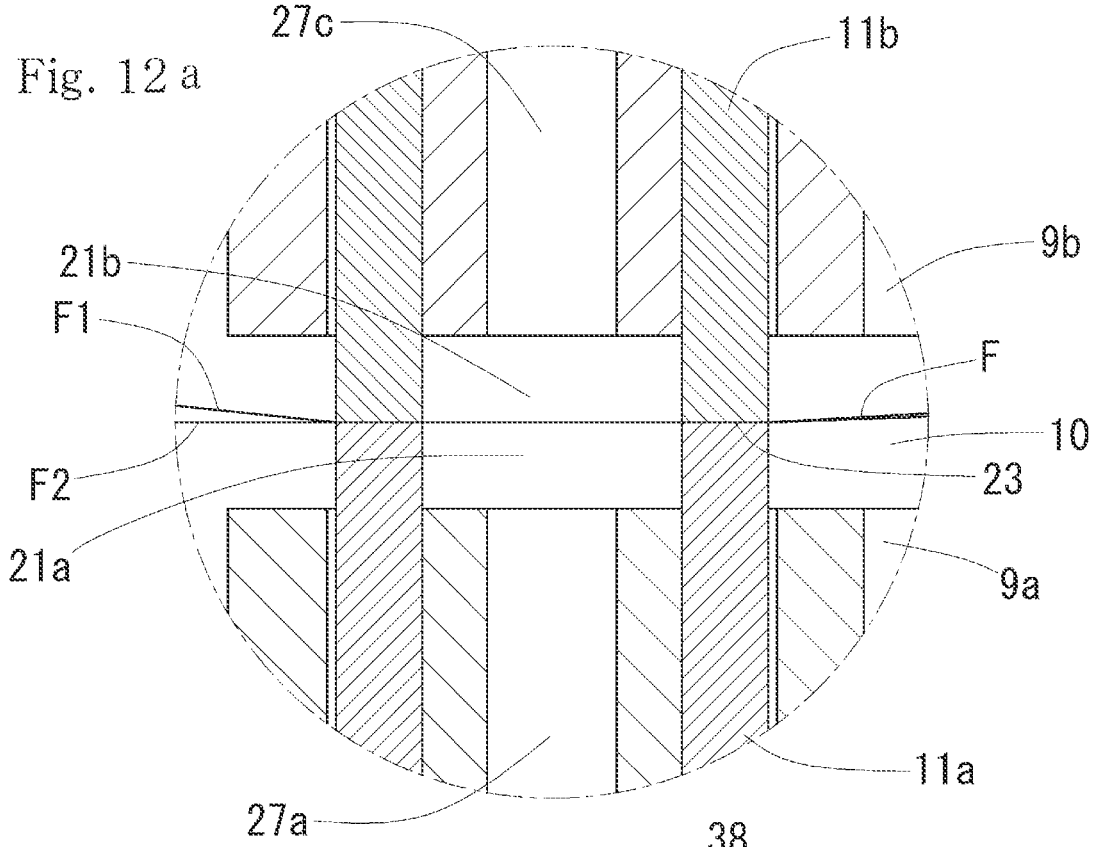
FIG. 12*a* is an enlarged view of a portion W in FIG. 11*a*.
Figure 13B:
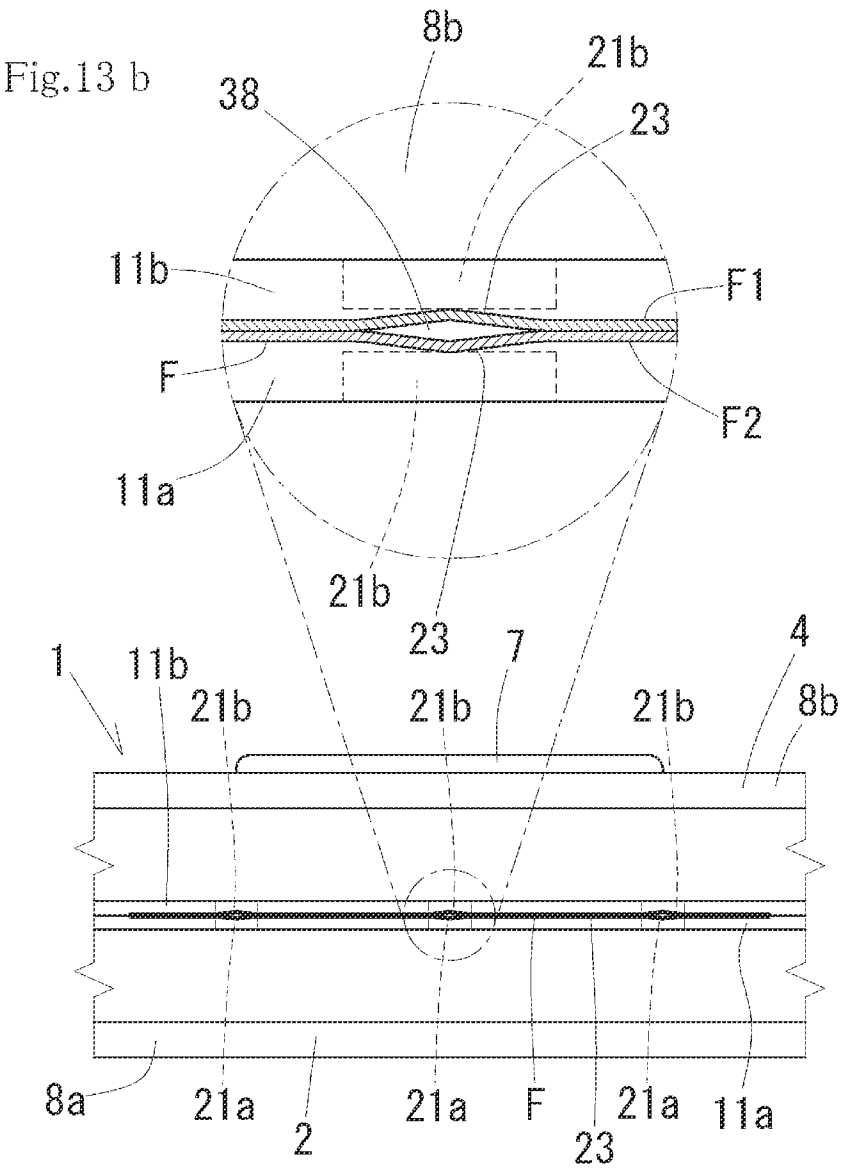
Figure 13A:
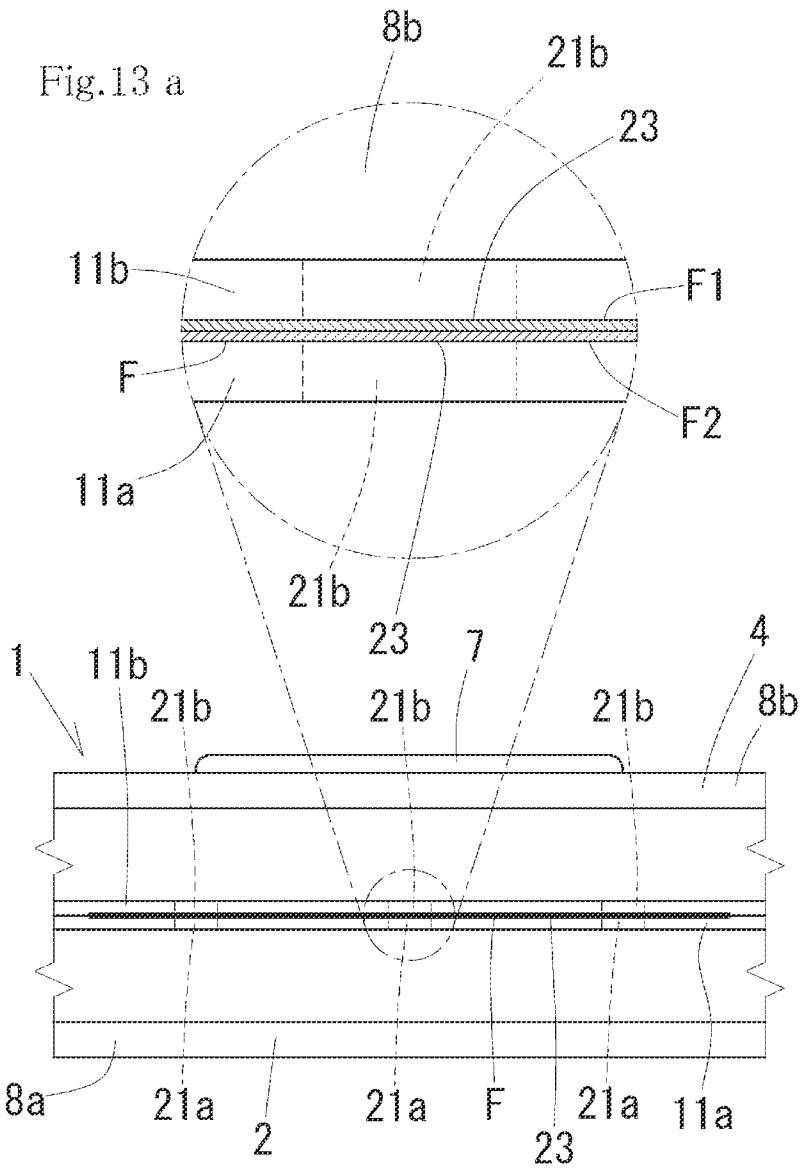

With the degasifier 1 of the present example, firstly the plastic packing bag F, which stores the packed material H is set, and the lid 4 is brought to the mount state. Then, the degassing process, which removes gas from the packing bag F, and a sealing process, which seals the bag opening G of the packing bag F in the degassed state, are performed. Specifically, as shown in FIG. 6, the packing bag F is set, when the lid 4 is in the released state, such that the bag opening G is placed on the electrically-heated wire 14 through the entire width inside the degassing chamber 10 and the packing bag F is overlapped on the suction opening 21*a* of the sandwiching surface 23. For the packing bag F, a generally available packing bag made with smooth plastic film is preferably used. The packing bag may be in any shape as long as one of the sides has the bag opening G. Three-side sealed bags, two-side sealed bags, and bottom-sealed bag are preferably used. When the packing bag F is set and the lid 4 is brought into the mount state to seal the degassing chamber 10, the packing bag F is sandwiched through its entire width by the sandwiching surfaces 23 of the gaskets 11*a*, 11*b*, as shown in FIG. 11*a*, 12*a*, 13*a*. Accordingly, the packing bag F is sandwiched in the state that the inside of the bag is separated to the inside and to the outside of the degassing chamber 10 by the gaskets 11*a*, 11*b*.

Figure 11B:
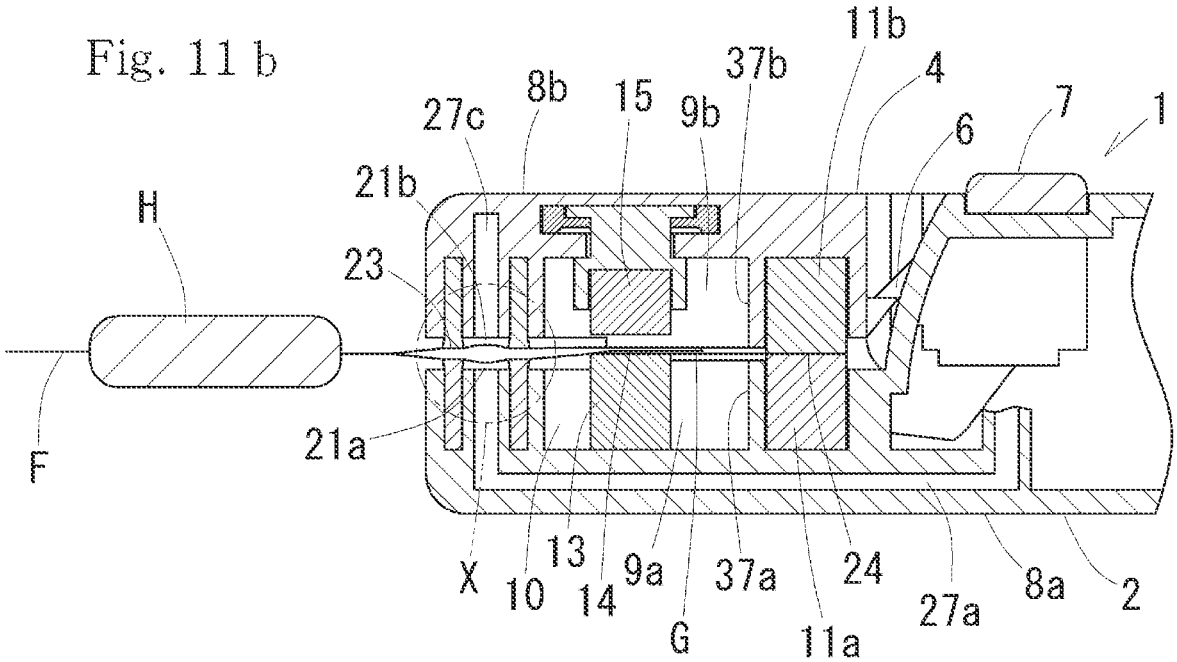
Figure 12B:
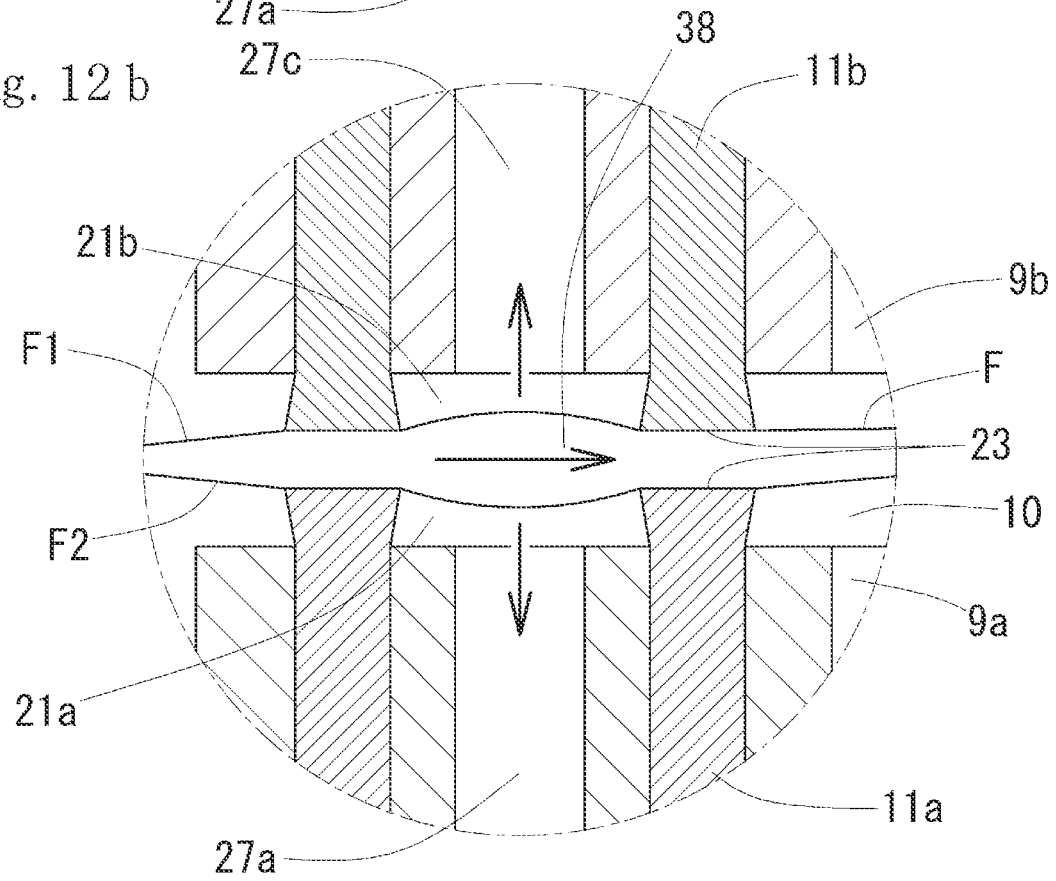
FIG. 12*b* is an enlarged view of a portion X in FIG. 11*b*.

When the lid 4 is hooked onto the movable hook 6 in the mount state, the open/close position detection switch 41 detects the displacement of the movable hook 6 and outputs a detection signal to the control device 40. Upon receiving the detection signal, the control device 40 starts the degassing process. Specifically, in the degassing process, firstly the vacuum pump 29 is operated and the solenoid valve 30*b* of the suction openings 27*a*, 27*b* are released, to decompress the inside of the suction openings 21*a*, 21*b*. When the inside of the suction openings 21*a*, 21*b* is decompressed and have the negative pressure, as shown in FIGS. 11*b*, 12*b*, 13*b*, the gaskets 11*a*, 11*b* around the suction openings 21*a*, 21*b* are attached to the upper side and the lower side of the packing bag F. At the same time, the sandwiching surfaces 23 are deformed in the separating direction so as to reduce a volume inside the decompressed suction openings 21*a*, 21*b*. Accordingly, around the suction openings 21*a*, 21*b*, front and back films F1, F2 are separated vertically and a space is created inside the packing bag F. When this space reaches the front edge and the back edge of the gaskets 11*a*, 11*b*, an airway 38, which communicates the inside and the outside of the degassing chamber 10, is formed inside the packing bag F. Incidentally, around the suction openings 21*a*, 21*b*, the sandwiching surface 23 of each of the gaskets 11*a*, 11*b* is attached to the films F1, F2 of the packing bag F. So, the outside air does not flow into the degassing chamber 10 from between the sandwiching surfaces 23, even if the sandwiching surfaces 23 are separated from each other around the suction openings 21*a*, 21*b*.

The control device 40, when the solenoid valve 30*b* of the suction pipes 27*a*, 27*b* has been released for a predetermined period, closes the solenoid valve 30*b* and holds the negative pressure state of the suction openings 21*a*, 21*b*. Incidentally, a length of the release time of the solenoid valve 30*b* may be chosen such that the length is long enough for the airway 38 to be formed around the suction openings 21*a*, 21*b*. Then, the control device 40 decompresses the degassing chamber 10 by releasing the solenoid valve 30*a* of the degassing pipe 25*a*. As shown in FIG. 12*b*, at this point, the inside of the packing bag F communicates with the degassing chamber 10 via the airway 38, and the pressing member 15 is separated from the electrically-heated wire 14. So, the air inside the packing bag F is smoothly discharged from the bag opening G to the degassing chamber 10 and drawn into the vacuum pump 29. Accordingly, as shown in FIG. 11*b*, the packing bag F is degassed and tightly attached to the surface of the packed material H.

Figure 14A:
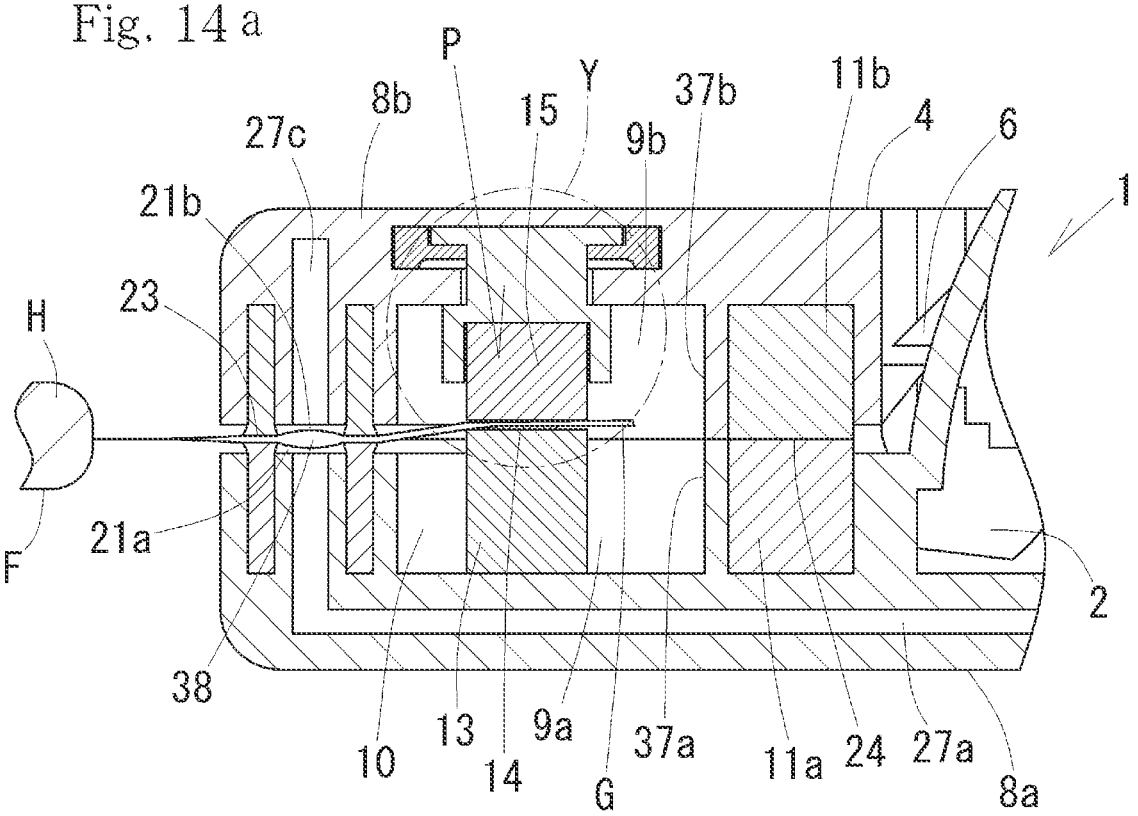
FIG. 14*a* and FIG. 14*b* is an explanatory view showing a degassing process continuing from FIG. 11*b*.
Figure 15A:
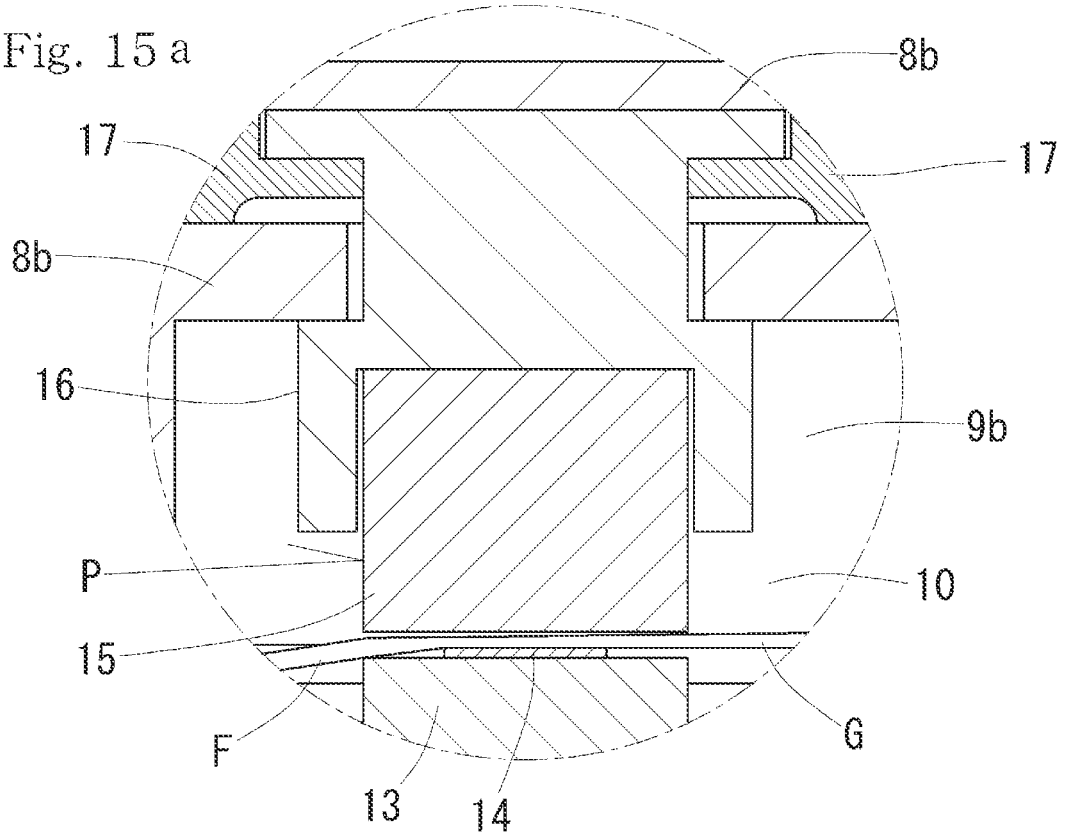
FIG. 15*a* is an enlarged view of a portion Y in FIG. 14*a*.
Figure 15B:
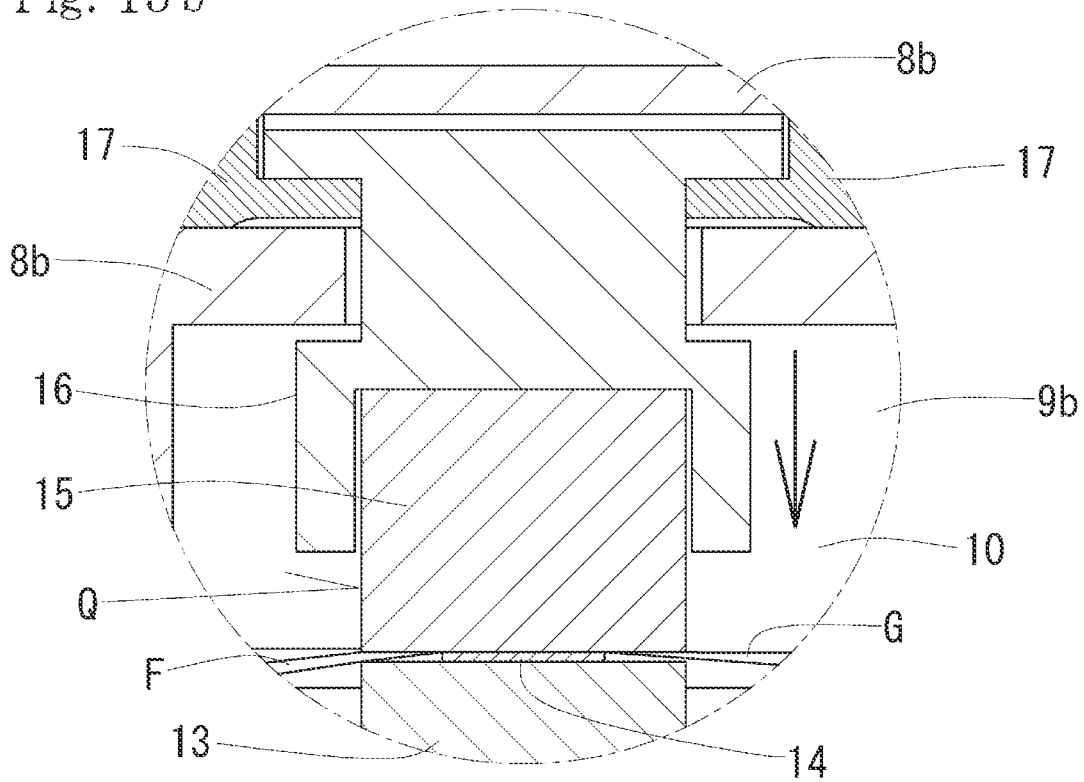
FIG. 15*b* is an enlarged view of a portion Z in FIG. 14*b*.

In the degassing process, when the air pressure of the degassing chamber 10 lowers, the lid 4 is pressed down by the pressure difference between the inside and outside of the degassing chamber 10. As shown in FIG. 14*a*, when the lid 4 is pressed down to a certain degree, the inner wall parts 37*a*, 37*b* of the cases 8*a*, 8*b*, which form the degassing chamber 10, abut each other, and the lid 4 stops lowering. If the gaskets 11*a*, 11*b* become in excessively close contact with each other by the lowering of the lid 4, the airway 38 formed between the gaskets 11*a*, 11*b* is crashed and the air in the packing bag F becomes hardly discharged. However, in the present example, the lowering of the lid 4 is avoided by the abutting of the inner wall parts 37*a*, 37*b*, such that the excessively close contact between the gaskets 11*a*, 11*b* is prevented, and the airway 38 is kept in the state where the air in the packing bag F is dischargeable. As shown in FIGS. 14*a*, 15*a*, by the lowering of the lid 4, the pressing member 15 comes close to the electrically-heated wire 14. At the point when the inner wall part 37*a* of the body side and the inner wall part 37*b* of the lid side are brought into contact with each other, the pressing member 15 is held at the evacuation position P and is apart from the electrically-heated wire 14. Therefore, the discharge of the air inside the packing bag F is not disrupted by the electrically-heated wire 14 and the pressing member 15.

The air pressure in the degassing chamber 10 is further reduced from the state where the lowering of the lid 4 is stopped by the abutting of the inner wall parts 37*a*, 37*b*, the holding member 16 held in the lid 4 is drawn downwards with more powerful force than the biasing force of the elastic gasket 17 by the air pressure difference between the inside and the outside of the degassing chamber 10. Accordingly, the pressing member 15 comes close to the electrically-heated wire 14. When the packing bag F is sufficiently degassed, and the air pressure of the degassing chamber 10 is reduced to a predetermined pressure or lower, the pressing member 15 lowers the bottom surface to the pressing position Q where the bottom surface and the electrically-heated wire 14 are abuttable, and the packing bag G arranged on the electrically-heated wire 14 is pressed against the electrically-heated wire 14 by the pressing member 15.

When the pressing member 15 lowers to the pressing position Q, the pressure detection switch 42 detects the displacement of the pressing member 15 and outputs the detection signal to the control device 40. Upon receiving this detection signal, the control device 40 closes the solenoid valve 30*a* and stops the vacuum pump 29, and then shifts from the degassing process to the sealing process. In the sealing process, the control device 40 turns on the electrically-heated wire energization switch 43, and temporarily supplies a large electric current to the electrically-heated wire. Then, by the heated electrically-heated wire 14, the bag opening G is heated and welded through the entire width and sealed accordingly. The control device 40, after a predetermined time has passed, turns off the electrically-heated wire energization switch 43 and sets the electrically-heated wire 14 to the unenergized state. Then, after a predetermined cooling time, the control device 40 finishes the sealing process.

The control device 40, after the sealing process is finish, releases the solenoid valves 30*a*, 30*b*, and flows in the outside air to the degassing chamber 10 and the suction openings 21*a*, 21*b*. At the same time, the control device 40 turns on the display lamp 12 with a predetermined aspect, and reports the finish of the degassing and sealing. Accordingly, by the operation of the release button 7, the lid 4 is changed to the released state to make the degassed and sealed packing bag F removable.

In this way, in the degasifier 1 of the present example, in the state that the packing bag F is sandwiched between the gaskets 11*a*, 11*b*, the suction openings 21*a*, 21*b* formed in the sandwiching surface 23 are decompressed to form the airway 38 between the gaskets 11*a*, 11*b*. Therefore, the air inside the packing bag F can be discharged from the bag opening G to the degassing chamber 10, even if the packing bag F has the smooth inner surface. Accordingly, in the degasifier 1 of the present example, degassing can suitably be performed without inserting a nozzle to the bag opening G, even if the packing bag F is made of plastic and has a smooth inner surface. With the degasifier 1 of the present example, the packing bag F does not have to be entirely stored in the degassing chamber 10. So, there is a benefit that the degasifier 10 can be realized compactly in size. With the degasifier 1 of the present example, degassing and sealing can be performed with the same method as the packing bag having the smooth inner surface, even if the packing bag is made of plastic and has a convex-concave inner surface. So, there is a benefit that in the case where only available packing bags are the ones with a convex-concave inner surface, the packed material H can be stored in said available packing bag, and degassed and sealed. Especially, in the present example, the inner wall parts 37*a*, 37*b* of the cases 8*a*, 8*b* function as a stopper that prevents the gaskets 11*a*, 11*b* from contacting excessively tightly. So, there is a benefit that the airway 38 can easily be formed around the suction openings 21*a*, 21*b*.

In the present example, the degasifier 1 is configured that, in the degassing process, when the degassing chamber 10 is decompressed to the predetermined pressure or lower, the pressing member 15 is lowered to the pressing position Q by the pressure difference between the inside and the outside of the degassing chamber 10 to make the bag opening G sealed with the electrically-heated wire 14. So, the air can smoothly be discharged from between the pressing member 15 and the electrically-heated wire 14 until the packing bag F becomes sufficiently degassed. Also, according to this structure, the pressing member 15 is displaced by the air pressure difference between the inside and the outside of the degassing chamber 10. So, there is also a benefit that the driving means for displacing the pressing member 15 becomes not necessary.

In the present example, the link openings 22*c*, 33*d* are formed, in the close-contact surface 24 of each of the gaskets 11*a*, 11*b*, in the position where the gaskets 11*a*, 11*b* are overlapped with each other in the mount state of the lid 4. And, the suction pipe 27*b* on the body side, which communicates the vacuum pump 29 and the link opening 22*c* of the body-side gasket 11*a*, and the suction pipe 27*c*, which communicates the suction opening 21*b* and the link opening 22*d* of the lid-side gasket 11*b*, are connected via the link openings 22*c*, 22*d* in the mount state of the lid 4. Because of this, with the degasifier 1 of the present example, the suction pipes 27*b*, 27*c*, which connect the suction opening 21*b* of the lid-side gasket 11*b* to the vacuum pump 29 can be simplified. Furthermore, in the released state of the lid 4, the suction pipes 27*b*, 27*c* are separated to the body side and the lid side, so the lid 4 can be moved relatively freely without being restrained by the suction pipes 27*b*, 27*c*.

Example 2

The present example is the one, in which the configuration of the example 1 is partially modified. Specifically, in the present example, the elastic gasket 17 according to the example 1 is formed with the material that has a higher elasticity modulus than the example 1, such that the holding member 16 is biased upwards stronger than the example 1, and the air pressure of the degassing chamber 10, when the pressing member 15 lowers to the pressing position Q, is lower than the example 1. The shape of the elastic gasket 17 is the same as the example 1, and the other configurations are the same as the example 1. So, in the following, some description is made with reference to the same drawings as the example 1, and the same reference signs as the example 1 are used in the description and the drawings.

The degasifier 1 of the present example is configured, in the same way as the example 1, that when the packing bag F is set and the lid 4 is brought to the mount state, the degassing process and the sealing process are performed in order. The degassing process of the present example progresses in the same way as the example 1 for a certain period of time from the start. That is, firstly, the inside of the suction openings 21*a*, 21*b* is decompressed by the vacuum pump 29, so that the gaskets 11*a*, 11*b* around the suction openings 21*a*, 21*b* become easily deformed by the pressure difference between the inside and the outside of the suction openings 21*a*, 21*b*. Accordingly, in the periphery of the suction openings 21*a*, 21*b*, the air inside the packing bag F becomes easily introduced to between the gaskets 11*a*, 11*b*. As shown in FIG. 12*b*, in the vicinity of the suction openings 21*a*, 21*b*, the air inside the packing bag F becomes able to pass between the gaskets 11*a*, 11*b* and flow out to the degassing chamber 10. In this state, the suction openings 21*a*, 21*b* have negative pressure, and the packing bag F is attached to each of the gaskets 11*a*, 11*b* around the suction openings 21*a*, 21*b*. Therefore, the outside air can hardly flow into the degassing chamber 10 from between the front and back films F1, F2 of the packing bag F and the sandwiching surface 23 of the gaskets 11*a*, 11*b*.

Then, in the same way as the degassing process of the example 1, while maintaining the negative pressure in the suction openings 21*a*, 21*b*, the degassing chamber 10 is decompressed. Accordingly, as shown in FIG. 12*b*, the air inside the packing bag F passes through the airway 38 formed between the gaskets 11*a*, 11*b* in the vicinity of the suction openings 21*a*, 21*b*, and is discharged from the bag opening G to the degassing chamber 10, and then sucked out by the vacuum pump 29. As shown in FIG. 11*b*, the packing bag F is gradually degassed and tightly attached to the surface of the packed material H. When the degassing chamber 10 is decompressed, the lid 4 is pressed down by the air pressure difference between the inside and outside of the degassing chamber 10. As shown in FIG. 14*a*, when the inner wall parts 37*a*, 37*b* of the cases 8*a*, 8*b* abut each other, the lid 4 stops lowering. The degassing process of the present example is performed in the same way as the example 1 to the point shown in FIG. 14*a*.

Figure 16:
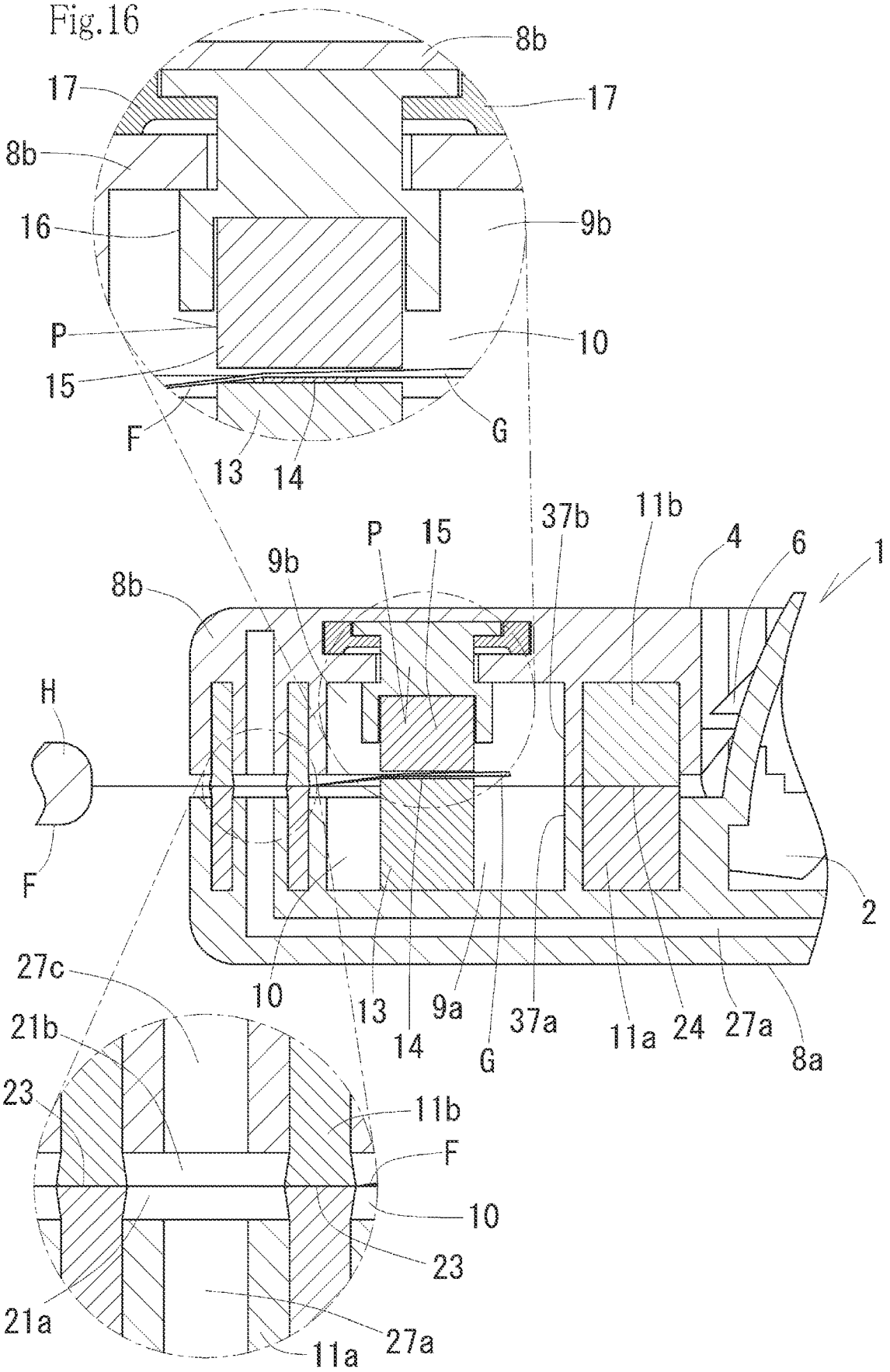
FIG. 16 is an explanatory view showing a degassing process according to a second example.
Figure 17:
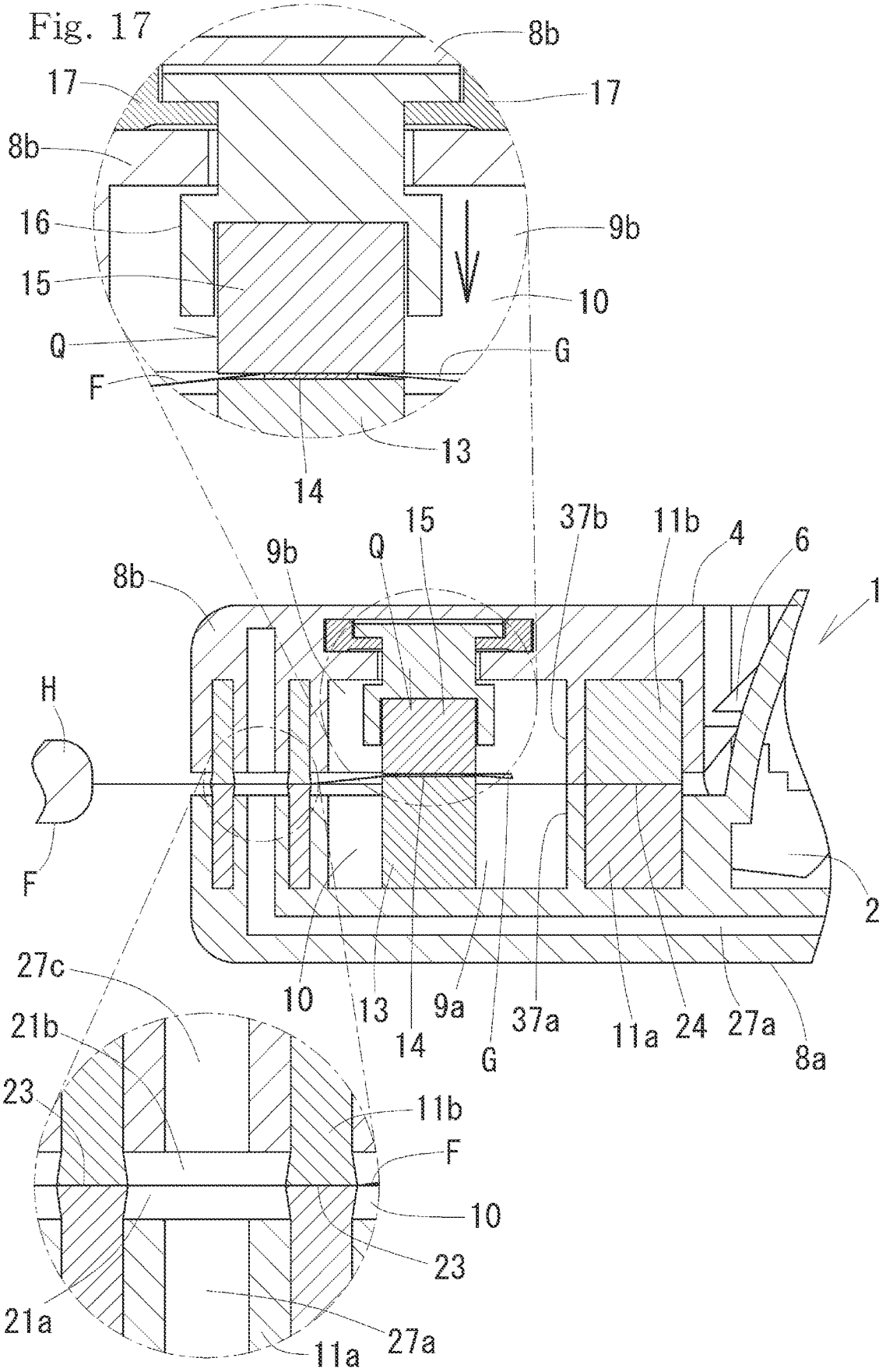
FIG. 17 is an explanatory view showing a degassing process according to a second example continuing from FIG. 16.

In the degassing process of this example, from the point shown in FIG. 14*a*, the degassing chamber 10 is further decompressed, and the degassing in the packing bag F progresses. Then, as the degassing in the packing bag F progresses and the air pressure inside the packing bag F lowers, the airway 38 shrinks narrower. Here, in the present example, as shown in FIG. 16, before the pressing member 15 lowers to the pressing position Q, the pressure of the air, which is about to pass through the airway 38, lowers the sandwiching force of the gaskets 11*a*, 11*b*, and then the airway 38 is closed. After the airway 38 is closed, when the air pressure of the degassing chamber 10 is reduced to the predetermined air pressure or lower, as shown in FIG. 17, the pressing member 15 lowers to the pressing position Q, and then the sealing process is started. The processes after the sealing process are the same as the example 1, so the explanation will be omitted.

Figure 14B:
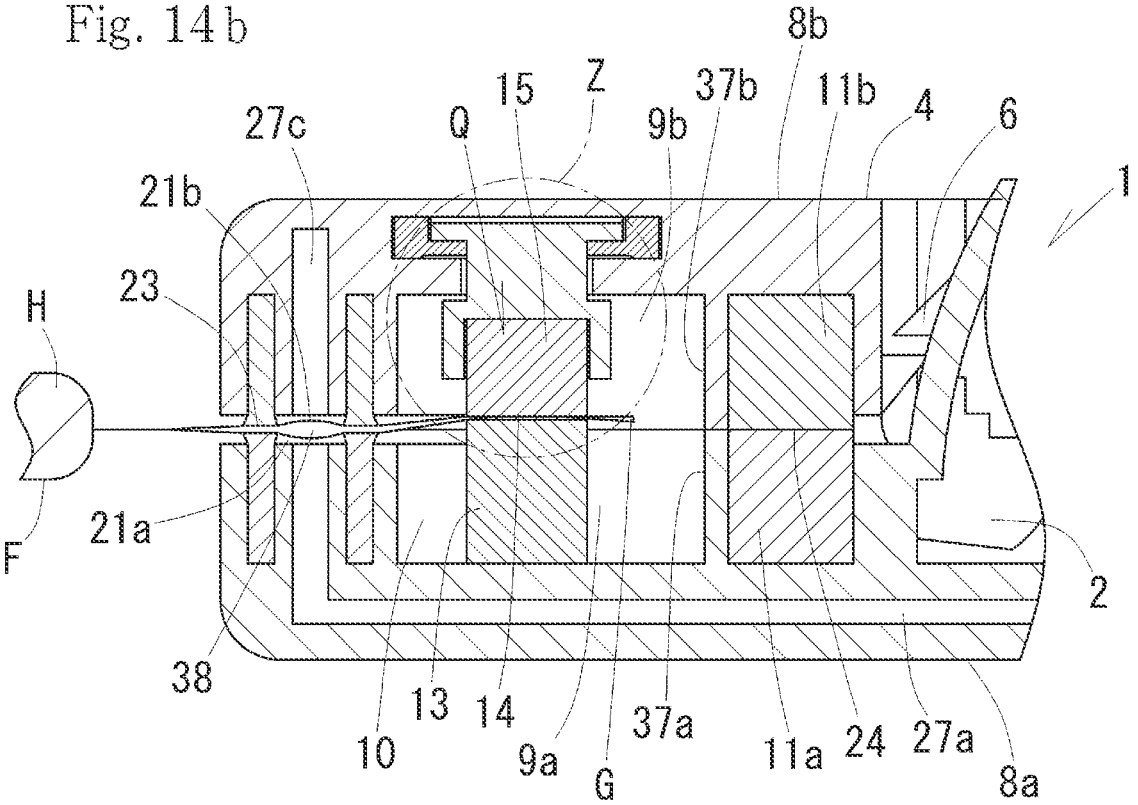

In this way, the degasifier 1 of the present example also produces the similar effects to the example 1 described above. However, in the present example, the air pressure in the degassing chamber 10 when the pressing member 15 lower to the pressing position Q is configured to be lower than the example 1. So, contrary to the example 1, in which the sealing process is started before the airway 38 is closed (refer to FIG. 14*b*), in the present example, the sealing process is started after the airway 38 is closed. In this way, in the degassing process, if the sealing process is performed after the airway 38 is closed, the air discharged from the airway 38 before the sealing of the bag opening G is prevented from back-flowing to the inside of the packing bag F.

Hereinbefore, the examples of the present invention have been described. However, the present invention is not limited to the above aspects of the examples, and may be modified in various ways without departing from the scope of the present invention. For example, in the degasifier 1 in the above example, the bag opening G is welded with the impulse seal method after the packing bag F is degassed. However, in the degasifier of the present invention, welding of the bag opening G may be performed with another method such as ultrasonic welding. Furthermore, the degasifier of the present invention may be the one, which only performs degassing of the packing bag F, and the sealing of the packing bag may be performed by an operator by hand using a clip. Also, the degasifier of the present invention may be the one, which, after degassing the packing bag F, fills inert gas in the bag.

In the above examples, the electrically-heated wire 14 is arranged in the body 2, and the pressing member 15 is arranged in the lid 4. However, the electrically-heated wire 14 may be arranged in the lid 4, and the pressing member 15 may be arranged in the body 2. The electrically-heated wire may also be arranged on the pressing member side so as to heat the bag opening from both sides.

The degasifier 1 of the present example is the one, in which the released state and the mount state is changed manually by operating the lid 4. However, the degasifier of the present invention may be the one, in which the lid is opened or closed by a motor or the like. In the above example, the pressing member 15 is moved from the evacuation position P to the pressing position Q by the air pressure difference between the inside and the outside of the degassing chamber 10. However, the pressing member 15 may be moved by a driving means such as a motor. In the above example, the detection signal of the pressure detection switch 42 is the signal of the finish of the degassing process. However, an air pressure sensor for detecting that the degassing chamber 10 is decompressed to the predetermined pressure may be arranged, and the degassing process may be finished upon receiving the detection signal from said air pressure sensor.

In the above example, in the degassing process, the decompression is conducted such that the degrees of vacuum in the suction openings 21*a*, 21*b* become higher than the degree of vacuum in the degassing chamber 10. However, in the degassing process, the decompression may be conducted such that the degrees of vacuum in the suction opening and the degassing chamber become the same. In the above example, the degassing process 10 is decompressed after the suction openings 21*a*, 21*b* are decompressed. However, in the degassing process, the decompression of the suction openings 21*a*, 21*b* and the degassing chamber 10 may be conducted at the same time by the vacuum pump 29.

In the above example, the lid 4 is linked to the body 2 via the arm 3. However, the lid according to the present invention may be mounted in such a manner as to directly movable in relation to the body 2. Also, as shown in the degasifiers 1*a*, 1*b* of the modification example in FIGS. 18, 19, the degasifier may be configured such that the lid 4 is separated from the body 2 in the released state. Incidentally, in FIGS. 18, 19, for the sake of convenience, the parts, which have differences in shape but are functionally common to the above example, are denoted with the same symbols.

Figure 18A:
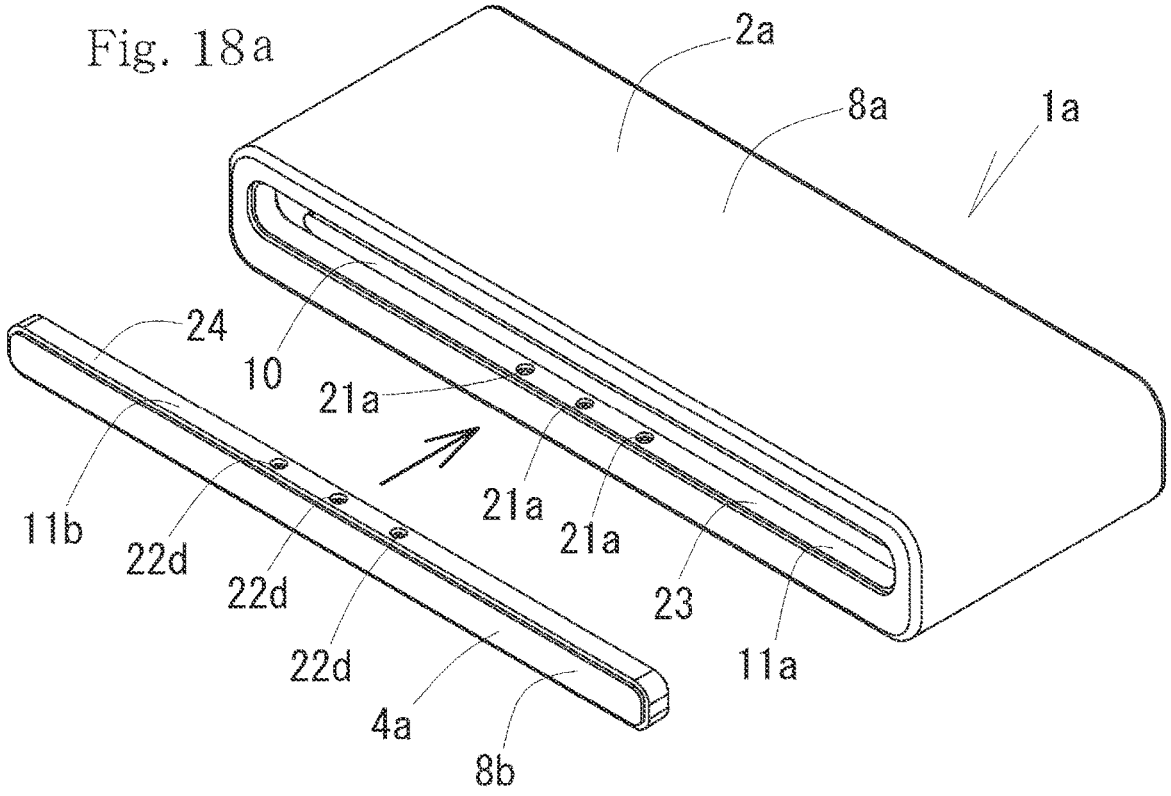
FIG. 18*a* is a perspective view.
Figure 18B:
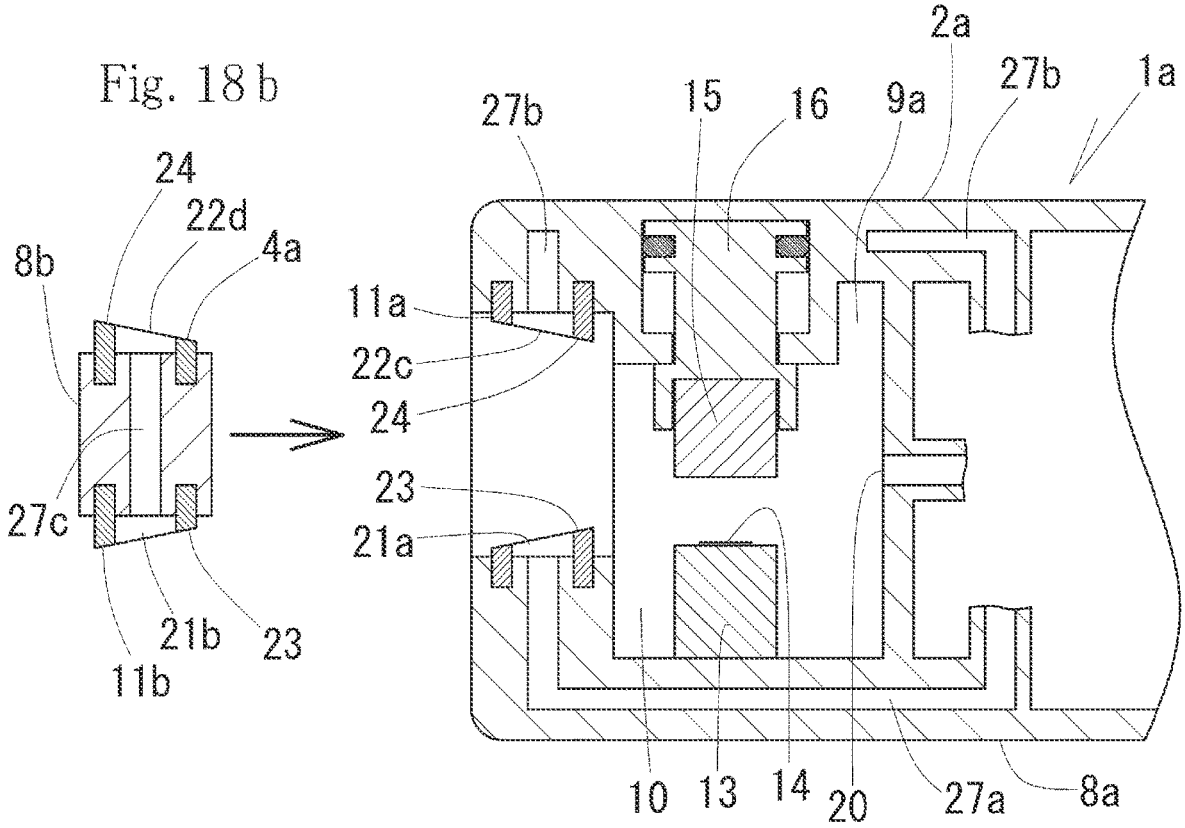
FIG. 18*b* is an enlarged longitudinal section view, according to a degasifier 1*a* of a modification example.
Figure 19A:
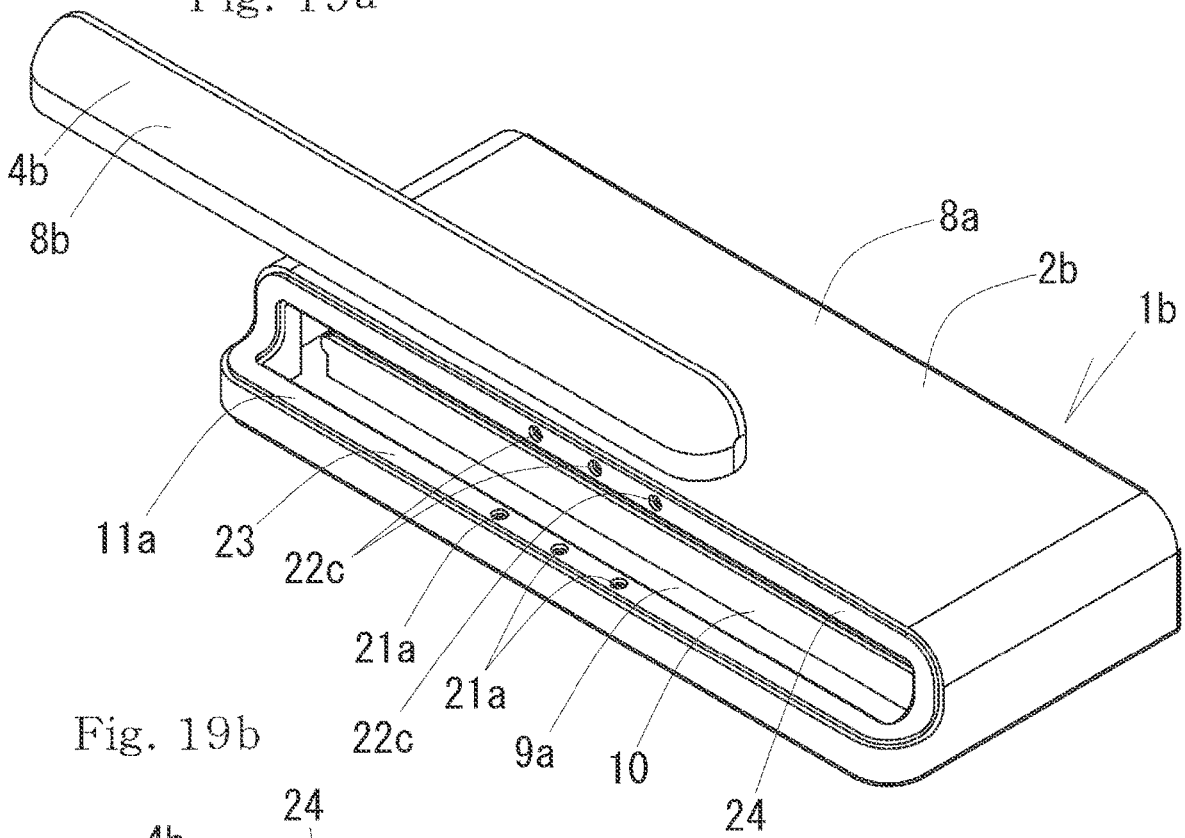
FIG. 19*a* is a perspective view.
Figure 19B:
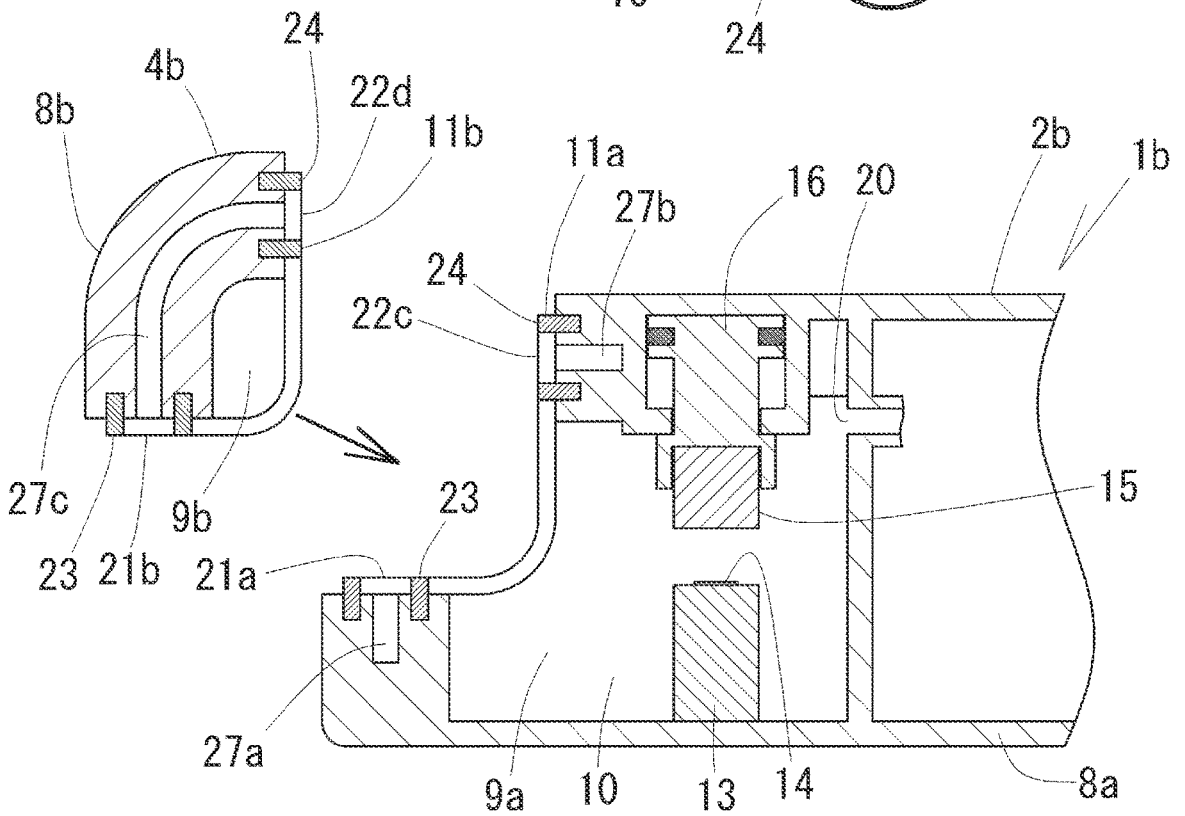
FIG. 19*b* is an enlarged longitudinal section view, according to a degasifier 1*b* of a modification example.

In the above example, the lid 4 is mounted on the body 2 in such a way as to cover from the top of the body 2. However, in the present invention, like a degasifier 1*a* shown in FIG. 18, the lid 4*a* may be fit into the body 2 from the front, or like a degasifier 1*b* shown in FIG. 19, the lid 4*b* may be attached to the body 2*b* from obliquely upwards. In the present example, in relation to the nearing and separating direction (vertical direction) of the body 2 and the lid 4, the sandwiching surface 23 of the gaskets 11*a*, 11*b* is arranged perpendicularly. However, as shown in FIGS. 18, 19, the sandwiching surface 23 may be tilted obliquely in relation to the nearing and separating direction of the bodies 2*a*, 2*b* and the lids 4*a*, 4*b*.

Figure 20A:
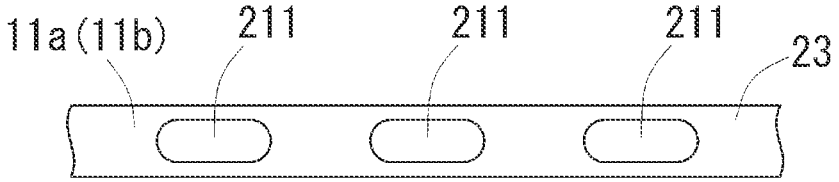
FIG. 20*a*, FIG. 20*b*, FIG. 20*c*, FIG. 20*d*, FIG. 20*e*, FIG. 20*f*, and FIG. 20*g* is an explanatory view showing suction openings 211 to 216 of an modification example.
Figure 20B:
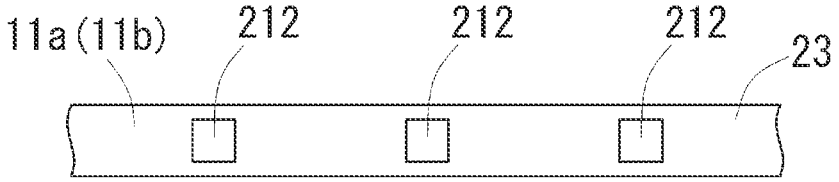
Figure 20C:
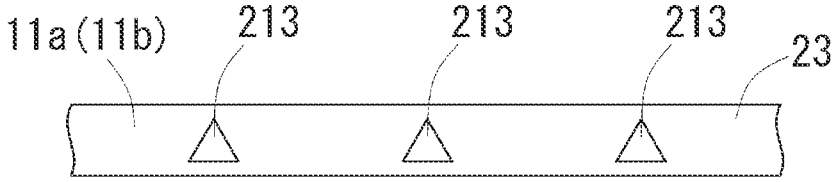
Figure 20D:
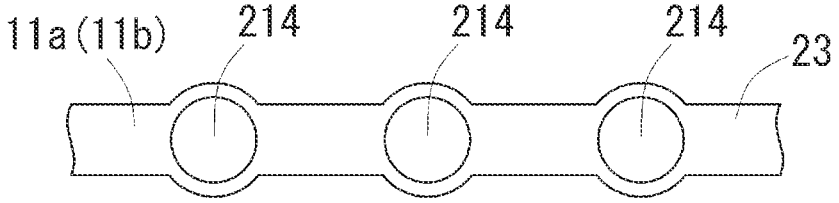
Figure 20E:
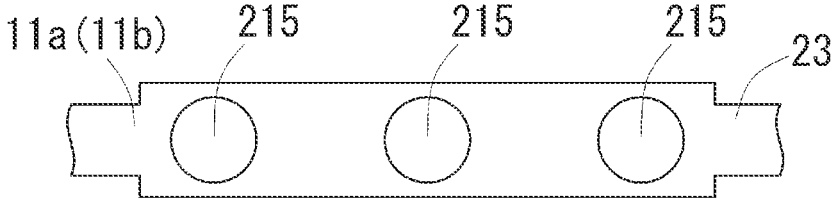
Figure 20F:
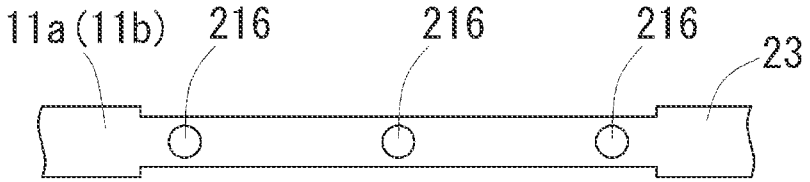
Figure 20G:
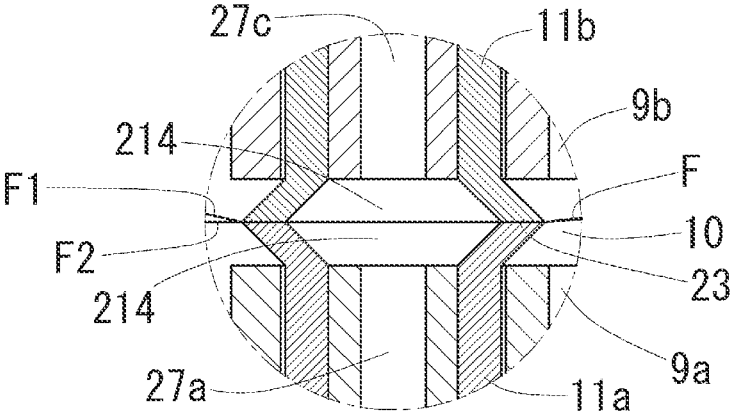

In the above example, the center portion of the sandwiching surfaces 23 of the gaskets 11*a*, 11*b* are each provided with three suction openings 21*a*, 21*b*. However, the number of suction openings may be 2 or less, or may be 4 or more. Also, the position of the suction openings 21*a*, 21*b* does not have to be the center portion of sandwiching surface 23. The suction openings 21*a*, 21*b* may be formed on the right side or on the left side, or may be formed through the entire width of the sandwiching surface 23. If the suction openings 21*a*, 21*b* are formed through the entire width of the sandwiching surface 23, the airway 38 can be formed at various places in the sandwiching surface 23. So, the packing bag F having a wide width can be degassed in a short period of time, and the packing bag F can be disposed relatively freely. Also, a plurality of packing bag F can be arranged side by side, and degassed and sealed at once, within the range of width of the sandwiching surface 23. The intervals between the suction openings 21*a*, 21*b* does not have to be uniform. The suction openings according to the present invention does not have be the round shape. As shown in the suction openings 211 to 213 in FIGS. 20*a* to 20*c*, the suction openings may be long-hole shapes, rectangular shapes, or triangular shapes. In the above example, the widths of the sandwiching surfaces of the gaskets 11*a*, 11*b* are uniform. However, as shown in FIGS. 20*d* to 20*f*, the portion, where the suction openings 214 to 216 are formed, may be in the wide width shape or narrow width shape. Especially, as shown in FIG. 20*d*, if the gaskets 11*a*, 11*b* are formed to be bulging out in the fore-and-aft direction, such that the suction openings 214 are in the round shape and the sandwiching surface 23 around said suction openings 214 is in the ring shape, the gaskets 11*a*, 11*b* become easily deformed in the front and the back of the suction opening 214, so the airway 38 becomes easily formed. Also, the packing bag F becomes easily tightly attached to the sandwiching surface 23, so the outside air can be securely prevented from flowing to the degassing chamber 10 from between the gaskets 11*a*, 11*b* and the packing bag F. Furthermore, if the configuration shown in FIG. 20*d* is chosen, as shown in FIG. 20*g*, the gaskets 11*a*, 11*b* should preferably be formed such that the diameter is gradually growing larger toward the suction opening 214. In such configuration, the gaskets 11*a*, 11*b* around the suction opening 214 have the shape similar to a sucking disk. So, the gaskets 11*a*, 11*b* become further easily deformed in the vertical direction and the further easily closely contact to the packing bag F. In general, the airway becomes more easily formed as the suction opening is made larger in relation to the sandwiching surface of the gasket. So, the size of the suction opening according to the present invention may suitably be set according to the sandwiching pressure on the packing bag F by the gaskets 11*a*, 11*b* or according to the degree of vacuum of the degassing chamber 10 or the suction openings 21*a*, 21*b*.

Also, in the present example, the gaskets 11*a*, 11*b* on the body side and the lid side are formed with a single material. However, the gasket according to the present invention may be formed with different materials for each region. For example, it is suggested that the constituent region of the sandwiching surface 23 is formed with a softer material than the constituent region of the close-contact surface 24. This is because airtightness is exclusively required for the close-contact surface 24, but on the other hand, for the sandwiching surface 23, flexibility for tightly contacting the surface of the packing bag F is also required. It is also suggested that the periphery of the suction openings 21*a*, 21*b* is formed with softer material than other regions. This is because the periphery of the suction openings 21*a*, 21*b* are required to deform while closely contacting the packing bag F so as to form the airway 38, and more flexibility is required than other regions. In this way, the gaskets 11*a*, 11*b*, which are formed with different material for each region, can preferably be manufactured as an integrally molded part by multicolor molding (different material composite molding).

In the above example, the biasing means, which biases the pressing member 15 to the evacuation position P, is configured with the elastic gasket 17. However, the biasing means according to the present invention may be configured with a coil spring or the like instead of the elastic gasket 17. In the above example, when the degassing chamber 10 is decompressed to the predetermined pressure or lower, the pressing member 15 moves to the pressing position Q automatically. However, the degasifier may be provided with a holding means, which holds the pressing member 15 at the evacuation position P even in the state where the degassing chamber 10 is decompressed to the predetermined pressure or lower. And the pressing member 15 may be moved, after the degassing chamber 10 is decompressed to the predetermined pressure or lower, to the pressing position Q at any timing by manually releasing the holding means. Configuration of the holding means is not specifically limited. As specific examples, there are, a locking mechanism that locks the pressing member 15 or the holding member 16 in the evacuation position P, and an open/close valve that prevents the outside air from flowing into the space outside the elastic gasket 17 so as not to generate the air pressure difference, which moves the elastic gasket 17 to the pressing position Q.

In the above example, the close-contact surfaces 24 around the link openings 22*a* to 22*d* are flat. However, one of the close-contact surfaces 24 around the link openings 22*a*, 22*c* may be formed in the convex shape, and the other close-contact surface 24 around the link openings 22*a* to 22*d* may be formed in the concave shape, and the opposing close-contact surfaces 24 may be fit around the link openings 22*a* to 22*d*.

In the above example, the airway 38 formed between the gaskets 11*a*, 11*b* is shown largely for the sake of convenience. However, the airway according to the present invention may be in any size as long as it allows the gas inside the packing bag to be discharged to the degassing chamber. For example, the airway may be such a narrow gap that it is almost invisible by eye.

REFERENCE SIGNS LIST

1, 1*a*, 1*b* Degasifier
2, 2*a*, 2*b* Body
4, 4*a*, 4*b* Lid
8*a*, 8*b* Case
9*a*, 9*b* Concave part
10 Degassing chamber
11*a*, 11*b* Gasket
14 Electrically-heated wire
15 Pressing member
16 Holding member
17 Elastic gasket (Biasing means)
21*a*, 21*b*, 211 to 216 Suction opening
22*a*, 22*b*, 22*c*, 22*d* Link opening
23 Sandwiching surface
24 Close-contact surface
27*a*, 27*b*, 27*c* Suction pipe
29 Vacuum pump
38 Airway
F Packing bag
G Bag opening
H Packed material
P Evacuation position
Q Pressing position

The invention claimed is:

1. A degasifier for removing gas from a packing bag, the degasifier comprising:

a degassing chamber which is openable and closable and is closed in a state where a lid of the degasifier is mounted on a body of the degasifier; and a pair of gaskets, wherein a first gasket of the pair of gaskets is provided in the body and a second gasket of the pair of gaskets is provided in the lid, and wherein the first gasket and the second gasket are in pressure-contact with each other around the degassing chamber when the degassing chamber is closed, wherein the packing bag is sandwiched between the pair of gaskets such that a bag opening of the packing bag is arranged inside the closed degassing chamber to degas the packing bag by decompressing the inside of the closed degassing chamber, wherein the first gasket and the second gasket include a first sandwiching surface and a second sandwiching surface, respectively, for sandwiching the packing bag, wherein the degasifier further comprises:

a pair or pairs of suction openings including a first suction opening disposed on the first sandwiching surface of the first gasket of the body and a second suction opening disposed on the second sandwiching surface of the second gasket of the lid without the first suction opening and the second suction opening opening directly into the degassing chamber, wherein the first suction opening and the second suction opening are disposed to mutually oppose each other while sandwiching the packing bag; and a decompressor that decompresses inside the suction openings, and wherein the pair or pairs of suction openings creates, inside the packing bag, an airway that communicates the inside and outside of the degassing chamber by decompressing the inside of each of the suction openings using the decompressor and creating suction against the packing bag using the suction openings while the bag opening of the packing bag having a smooth surface is arranged in the closed degassing chamber and sandwiched between the first sandwiching surface of the first gasket on which the first suction opening is disposed and the second sandwiching surface of the second gasket on which the second suction opening is disposed.

2. The degasifier according to claim 1, wherein in a state where the packing bag is degassed, the bag opening of the packing bag is sealed, one of the body and the lid is provided with an electrically-heated wire to seal the bag opening in the degassing chamber, the other of the body and the lid is provided with a pressing member to press the bag opening to the electrically-heated wire in the degassing chamber, the pressing member is held in the closed degassing chamber such that the pressing member is movable between i) a pressing position where the bag opening arranged between the electrically-heated wire and the pressing member is pressed to the electrically-heated wire and ii) an evacuation position where the bag opening cannot be pressed to the electrically-heated wire, the pressing member is biased toward the evacuation position by an elastic force of a biasing means, and when the inside of the closed degassing chamber is decompressed to a predetermined pressure or lower, the pressing member moves to the pressing position against the elastic force of the biasing means by an air pressure difference between the inside and the outside of the closed degassing chamber.

3. The degasifier according to claim 1, wherein the decompressor comprises:

a vacuum pump arranged in the body;

a first suction pipe that communicates the first suction opening of the pair or pairs of suction openings provided on the first gasket on the body to the vacuum pump; and a second suction pipe that communicates the second suction opening of the pair or pairs of suction openings provided on the second gasket on the lid to the vacuum pump, the first and second gaskets include first and second close-contact surfaces, respectively, the first and second close-contact surfaces do not sandwich the packing bag, the first close-contact surface on the first gasket includes a first link opening, the second close-contact surface on the second gasket includes a second link opening, in the state where the degassing chamber is closed, the first link opening and the second link opening align with each other such that the first link opening and the second link opening overlap each other, and the second suction pipe comprises:

a body-side suction pipe that is arranged in the body and communicates the first link opening of the first gasket on the body side to the vacuum pump; and a lid-side suction pipe that is arranged in the lid and communicates the second suction opening of the second gasket on the lid side to the second link opening of the second gasket on the lid side.

4. The degasifier according to claim 1, comprising a stopper that prevents a degree of close-contact of the pair of gaskets from becoming a predetermined degree or more in a state where the degassing chamber is closed.

* * * * *